US006543101B2

(12) United States Patent
Sack et al.

(10) Patent No.: US 6,543,101 B2
(45) Date of Patent: Apr. 8, 2003

(54) THREE AND FIVE POINT BUCKLE

(75) Inventors: James A. Sack, Elverson, PA (US); Arthur L. Gehr, Jr., East Earl, PA (US); Glenn E. Gehr, New Holland, PA (US)

(73) Assignee: Wonderland Nurserygoods Co., Ltd., Taipei (TW)

( * ) Notice: Subject to any disclaimer, the term of this patent is extended or adjusted under 35 U.S.C. 154(b) by 0 days.

(21) Appl. No.: 09/769,745

(22) Filed: Jan. 26, 2001

(65) Prior Publication Data

US 2002/0017012 A1 Feb. 14, 2002

Related U.S. Application Data

(60) Provisional application No. 60/177,661, filed on Jan. 27, 2000.

(51) Int. Cl.[7] ..... A44B 11/25

(52) U.S. Cl. ..... 24/633; 24/625; 24/629; 24/636; 24/642; 280/801.1; 280/802; 297/468

(58) Field of Search ..... 24/625, 629, 633, 24/640, 641, 642, 636, 653, 656, 664, 573.1–573.5, 588; 297/468, 483, 485; 280/801.1, 802

(56) References Cited

U.S. PATENT DOCUMENTS

| | | | | | |
|---|---|---|---|---|---|
| 3,564,672 | A | * | 2/1971 | Mc Intyre | 24/632 |
| 3,605,207 | A | * | 9/1971 | Glauser et al. | 24/632 |
| 3,639,948 | A | * | 2/1972 | Sherman | 24/632 |
| 3,825,979 | A | * | 7/1974 | Jakob | 24/579.11 |
| 4,023,826 | A | * | 5/1977 | Kokubo et al. | 24/163 R |
| 4,502,191 | A | | 3/1985 | Savage | 24/580 |
| 4,644,618 | A | | 2/1987 | Holmberg | 24/630 |
| 4,682,390 | A | * | 7/1987 | Parrish | 24/632 |
| 4,742,604 | A | * | 5/1988 | Mazelsky | 24/579.09 |
| 4,800,629 | A | | 1/1989 | Ikeda | 24/170 |
| 4,977,650 | A | | 12/1990 | Ida | 24/614 |
| 5,113,556 | A | | 5/1992 | Murai et al. | 24/633 |
| 5,182,837 | A | | 2/1993 | Anthony et al. | 24/642 |
| 5,406,681 | A | | 4/1995 | Olson | 24/650 |
| 5,471,717 | A | | 12/1995 | Ennerdal et al. | 24/633 |
| 5,542,161 | A | | 8/1996 | Anscher | 24/614 |
| 5,551,131 | A | | 9/1996 | Anscher | 24/614 |
| 5,604,964 | A | | 2/1997 | Aoshima | 24/632 |
| 5,659,931 | A | | 8/1997 | Anscher | 24/614 |
| 5,665,002 | A | * | 9/1997 | Balwanz | 472/118 |
| 5,893,199 | A | | 4/1999 | Anscher | 24/625 |
| 6,000,109 | A | | 12/1999 | Anscher | 24/614 |
| 6,049,954 | A | | 4/2000 | Britto | 24/573.1 |
| 6,061,883 | A | | 5/2000 | Uehara | 24/625 |
| 6,283,350 | B1 | * | 9/2001 | Gottmeier et al. | 224/627 |
| 6,309,024 | B1 | * | 10/2001 | Busch | 24/170 |

FOREIGN PATENT DOCUMENTS

| | | | |
|---|---|---|---|
| DE | 82 30 071 | 9/1983 | |
| DE | 298 07 680 U1 | 9/1998 | 11/14 |
| EP | 0 046 672 | 3/1982 | |
| EP | 0 094 211 | 11/1983 | |
| EP | 0 943 253 A2 | 9/1999 | 11/26 |
| FR | 2 778 070 | 11/1999 | 11/25 |
| JP | 08089314 | 4/1996 | 11/26 |
| WO | WO90/09747 | 9/1990 | |

* cited by examiner

*Primary Examiner*—J. J. Swann
*Assistant Examiner*—André Jackson
(74) *Attorney, Agent, or Firm*—McKenna Long & Aldridge LLP

(57) ABSTRACT

A multi-point buckle assembly includes a body having a top opening on a top surface, a plurality of side openings, and a plurality of channels, a release button disposed within the top opening, a plurality of main tongues, and a plurality of side tongues, wherein each of the plurality of main tongues is adapted to fit into each of the plurality of side openings and each of the plurality of side tongues is adapted to fit into each of the plurality of channels.

18 Claims, 28 Drawing Sheets

THREE AND FIVE POINT BUCKLE

This application claims the benefit of Provisional Application No. 60/177,661, filed on Jan. 27, 2000.

BACKGROUND OF THE INVENTION

1. Field of the Invention

The present invention relates to a three and a five-point buckle with a multi-bar webbing lock, and more particularly to a buckle with a floating latch, wherein for operation in a five point mode, the buckle is adapted to receive four tongues and may be used with a multi-point restraint system. An alternate embodiment of the present invention relates to a three and a five-point buckle with a multi-bar webbing lock, and more particularly to a buckle with a floating latch, wherein for operation in a three-point mode, the buckle is adapted to receive two tongues and may be used with a multi-point restraint system. Another alternate embodiment of the present invention also relates to a three and a five-point buckle with a multi-bar webbing lock, and more particularly to a buckle with a floating latch, wherein for operation in a three-point or a five-point mode, the buckle is adapted to receive two tongues and may be used with a multi-point restraint system.

2. Discussion of the Related Art

A number of conventional buckle designs are known in the prior art. These designs generally suffer from problems and deficiencies relating to operability and reliability. Also, such conventional buckles are often expensive and difficult to manufacture and assemble.

CROSS REFERENCE TO RELATED APPLICATIONS

The present invention, in its broader aspects, shares several common features and inventive concepts with Provisional Application No. 60/174,306, filed on Jan. 3, 2000. The present application is intended to be read in conjunction with this application as if it appeared herein, and is incorporated herein by reference. It should be understood various features and aspects of the present application which correspond to features and aspects of Provisional Application No. 60/174,306, could be used interchangeably by one of ordinary skill in the art.

SUMMARY OF THE INVENTION

Accordingly, the present invention is directed to a multi-point buckle that substantially obviates one or more of the problems due to limitations and disadvantages of the related art.

An object of the present invention is to provide a three and five-point buck that is easy to manufacture and assemble.

Another object of the present invention is to provide a three and five-point buckle with a multi-bar webbing lock.

Another object of the present invention is to provide a three and five-point buckle with floating latches.

Additional features and advantages of the invention will be set forth in the description which follows, and in part will be apparent from the description, or may be learned by practice of the invention. The objectives and other advantages of the invention will be realized and attained by the structure particularly pointed out in the written description and claims hereof as well as the appended drawings.

To achieve these and other advantages and in accordance with the purpose of the present invention, as embodied and broadly described, a multi-point buckle assembly includes a body having a top opening on a top surface, a plurality of side openings, and a plurality of channels, a release button disposed within the top opening, and a plurality of main tongues, wherein the plurality of side openings and the plurality of channels are formed in different planes and each of the plurality of main tongues is adapted to fit into each of the plurality of side openings.

In another aspect of the present invention, a multi-point buckle assembly includes a body having a top opening on a top surface and a plurality of side openings, a release button disposed within the top opening, a plurality of main tongues, wherein each of the plurality of main tongues includes a plurality of strap insertion regions.

It is to be understood that both the foregoing general description and the following detailed description are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principles of the invention. In the drawings.

DETAILED DESCRIPTION OF THE PREFERRED EMBODIMENTS

Figure 1A:
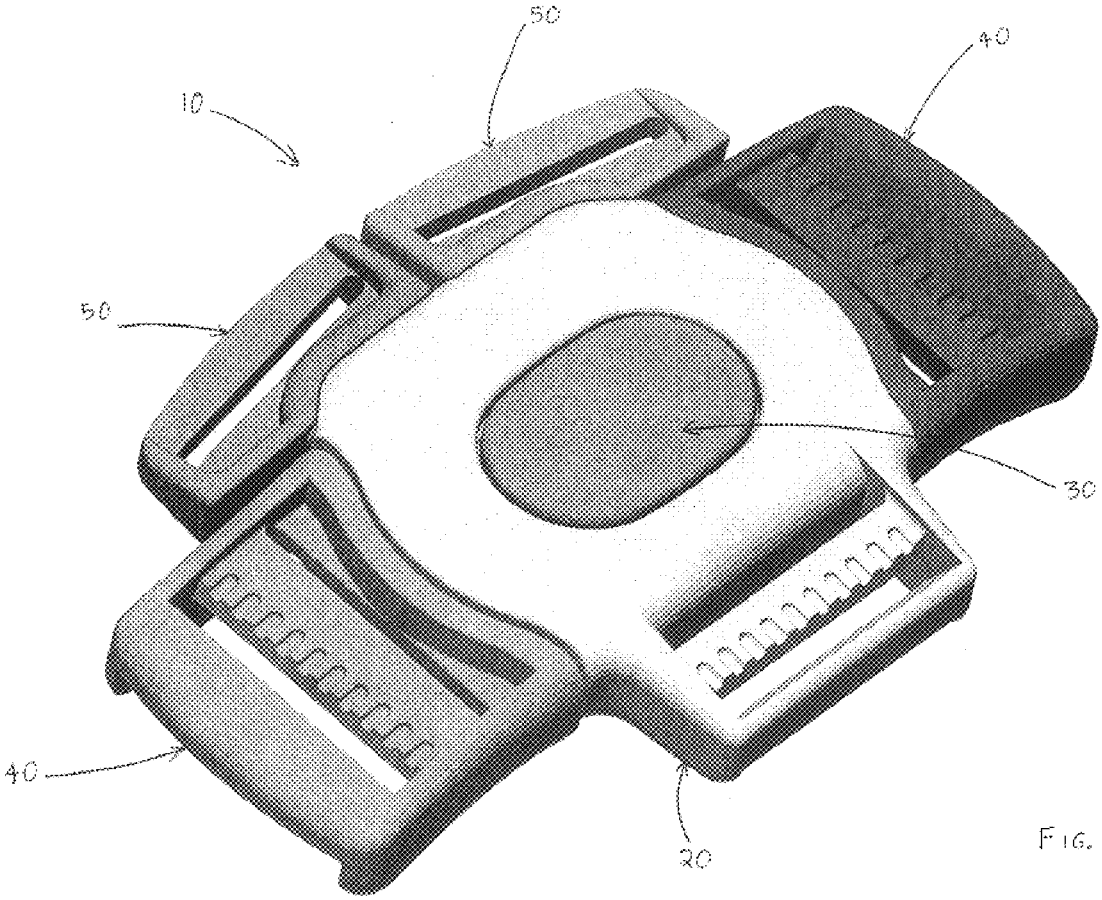
FIG. 1A shows an isometric view of a first embodiment of the three and five-point buckle assembly of the present invention in the assembled five-point mode.

Reference will now be made in detail to the preferred embodiments of the present invention, examples of which are illustrated in the drawings.

The first and second embodiments of the three and five-point buckle assemblies of the present invention will now be described in detail.

Figure 2:
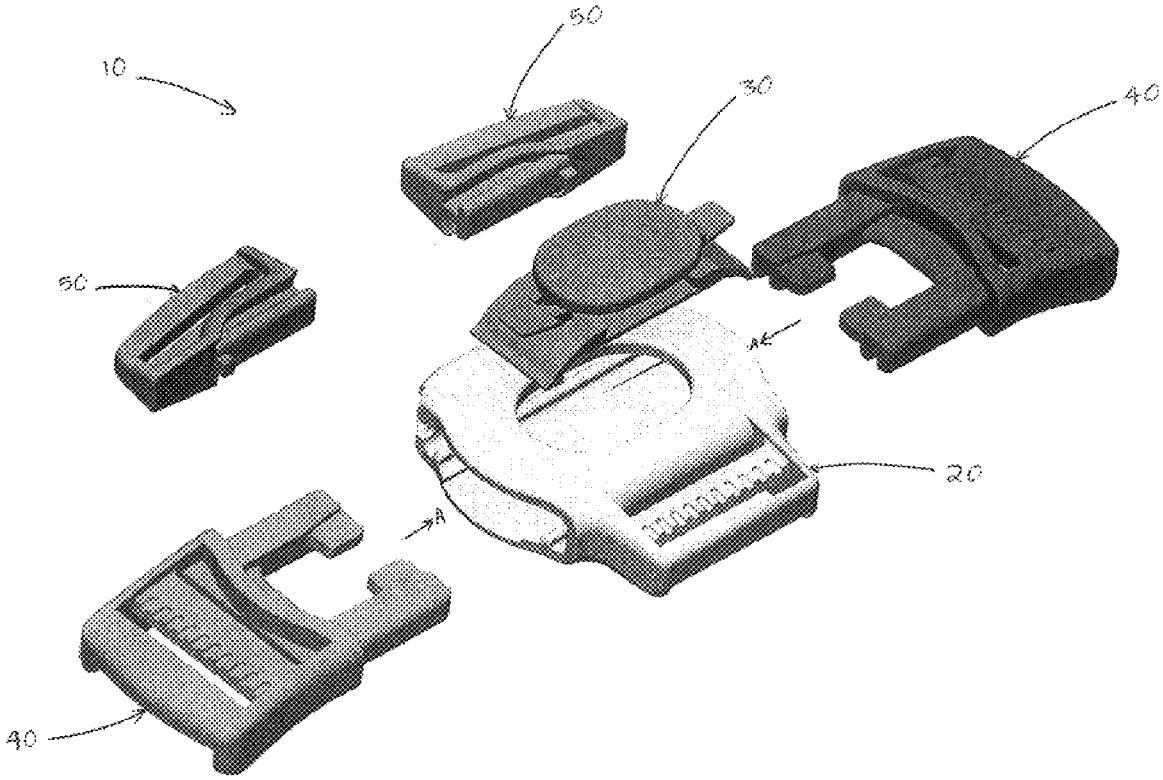
FIG. 2 shows an isometric exploded view of the first embodiment of the three and five-point buckle assembly of the present invention.

FIG. 1A shows an isometric view of a first embodiment of the three and fivepoint buckle assembly 10 of the present invention in the assembled five-point mode. FIG. 2 shows an isometric exploded view of the first embodiment of the three and five-point buckle assembly 10 of the present invention. The three and five-point buckle assembly 10 preferably includes the following components; a buckle body 20, a release button 30, two identical main-tongues 40, and two identical side-tongues 50 (or 50' shown in FIG. 14B).

Figure 1B:
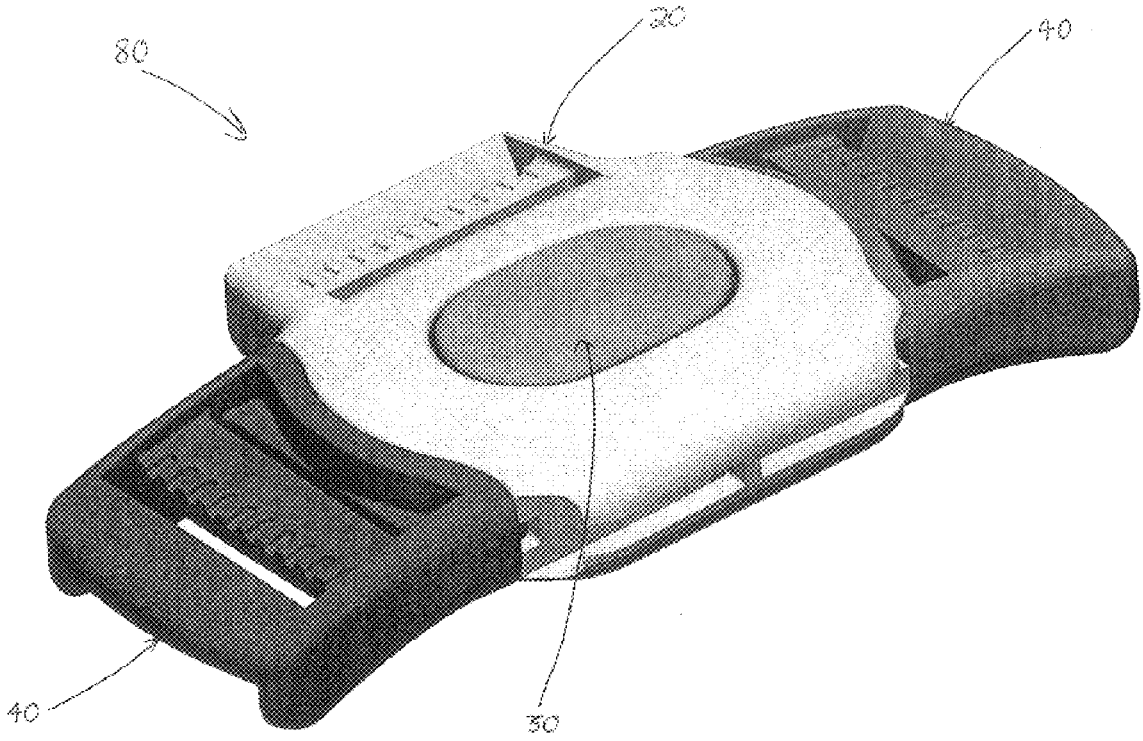
FIG. 1B shows an isometric view of a second embodiment of the three and five-point buckle assembly of the present invention in the assembled three-point mode.

FIG. 1B shows an isometric view of a second embodiment of the three and five-point buckle assembly 80 of the present invention in the assembled three-point mode. The three and five-point buckle assembly 80 preferably includes the following components: a buckle body 20, a release button 30, and two identical main-tongues 40.

It should be noted that a difference between the first and second embodiments of the three and five-point buckle assemblies 10 and 80, respectively, is that for the second embodiment, the side-tongues 50 (or 50') are removed and/or not utilized. Thus, for the three and five-point buckle assemblies 10 and 80, respectively, the five-point mode (FIG. 1A) allows for a five-point restraint on an individual, and the three-point mode (FIG. 1B) allows for a three-point restraint on an individual. For example, it will be appreciated that the preferred system could be readily converted between a three point and a five point mode simply by removing and/or not utilizing the side tongues 50 (or 50').

Each of the components of the first and second embodiments of the three and five-point buckle assemblies 10 and 80 will now be explained in detail.

Figure 3:
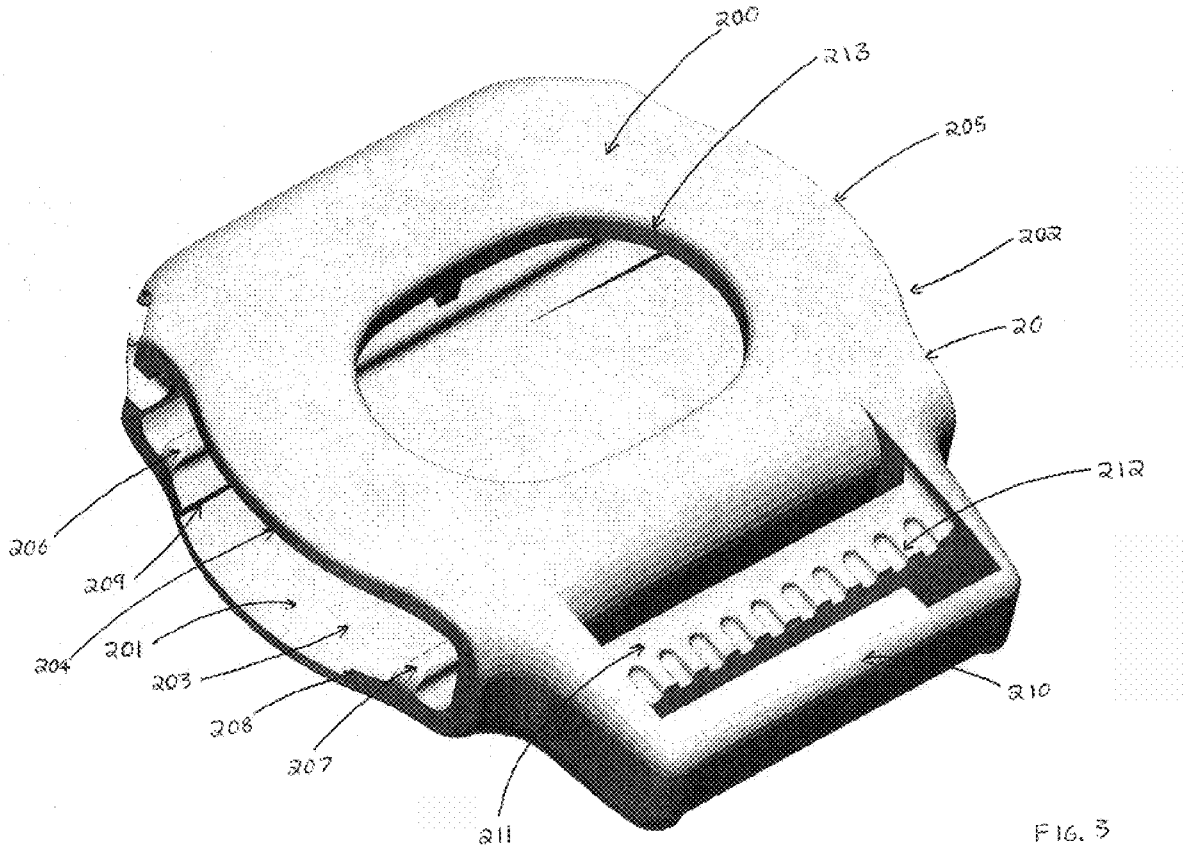
FIG. 3 shows an isometric view of a first embodiment of a buckle body illustrating the top surface.
Figure 4:
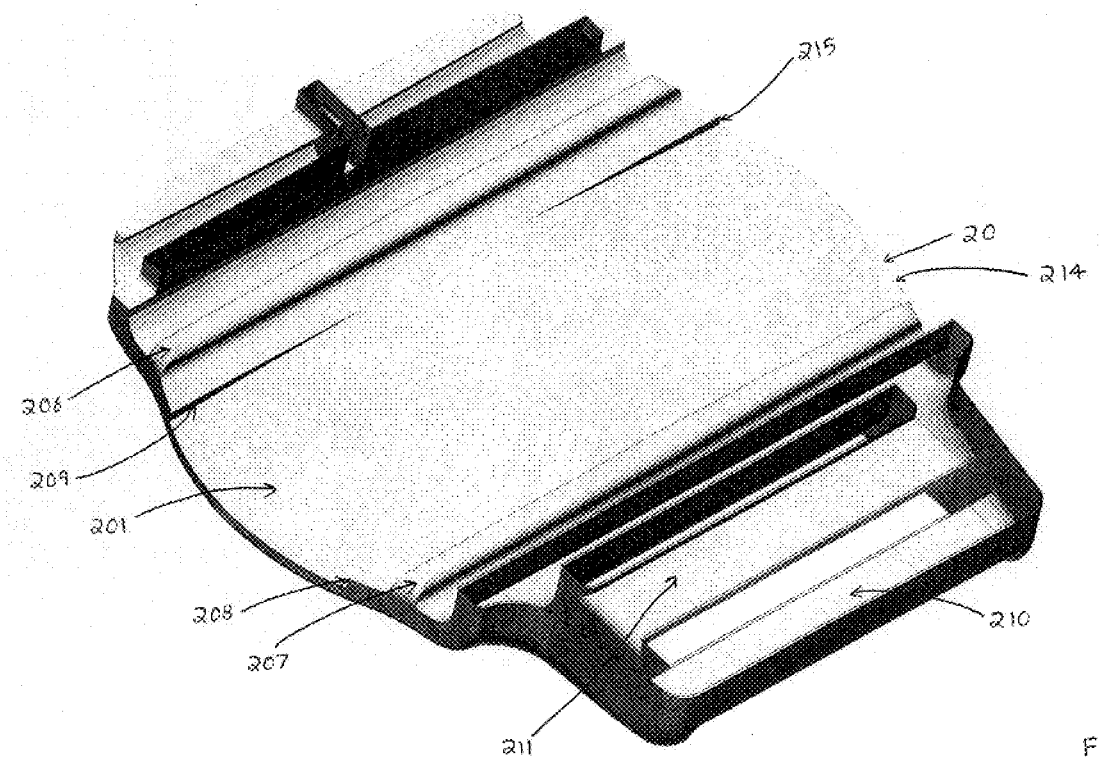
FIG. 4 shows an isometric section view of the first embodiment of the buckle body with the top surface removed.
Figure 5:
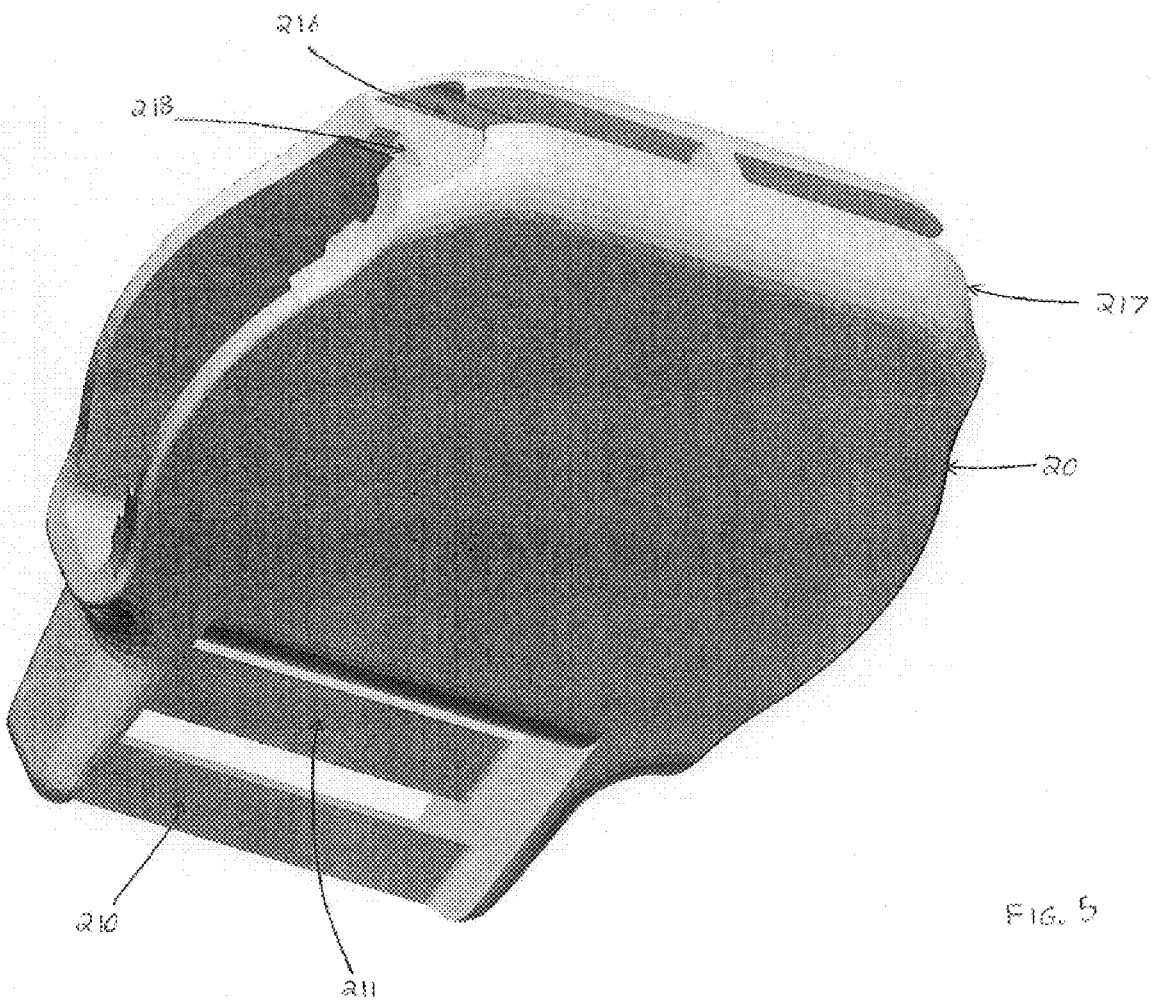
FIG. 5 shows an isometric view of the first embodiment of the buckle body illustrating the bottom surface.
Figure 6:
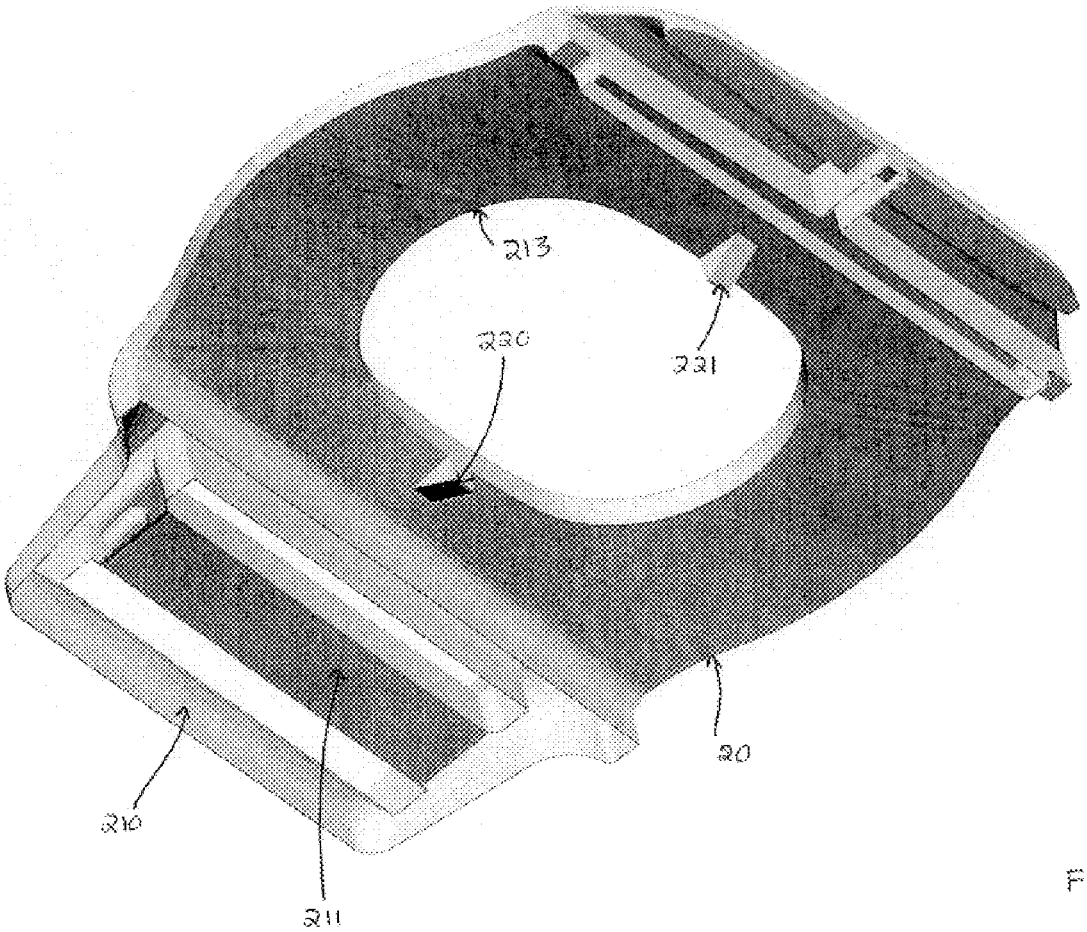
FIG. 6 shows an isometric section view of the first embodiment of the buckle body with the bottom surface removed.
Figure 7:
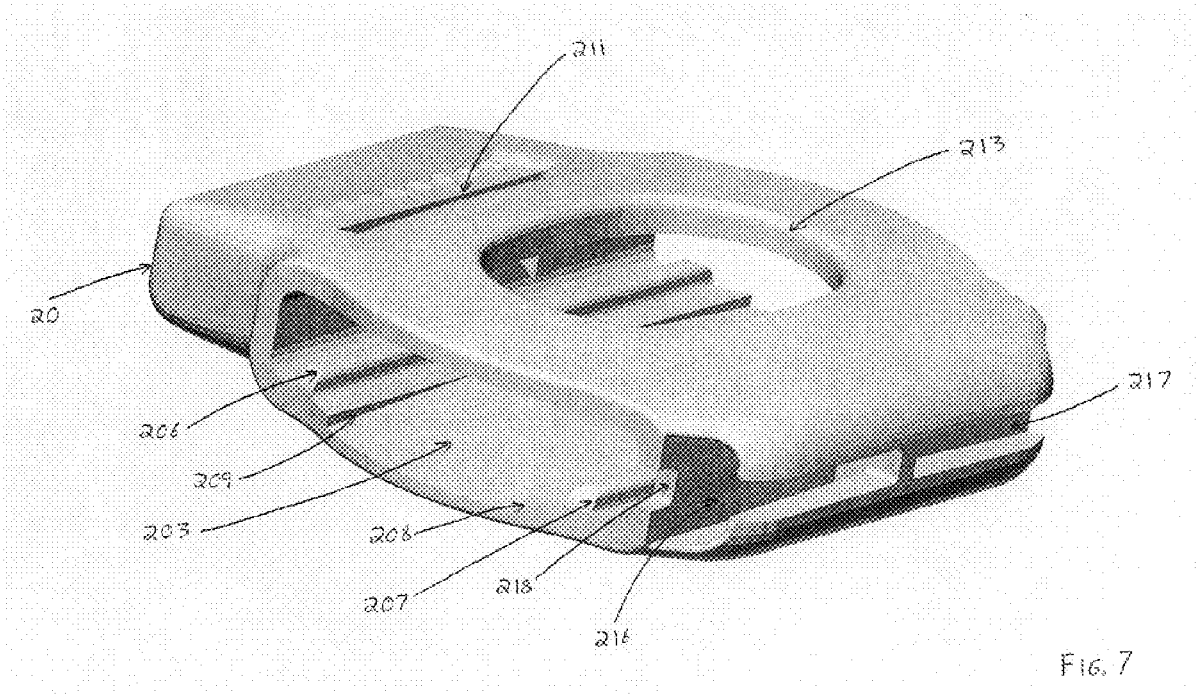
FIG. 7 shows an alternate isometric view of the first embodiment of the buckle body illustrating the top surface.
Figure 8:
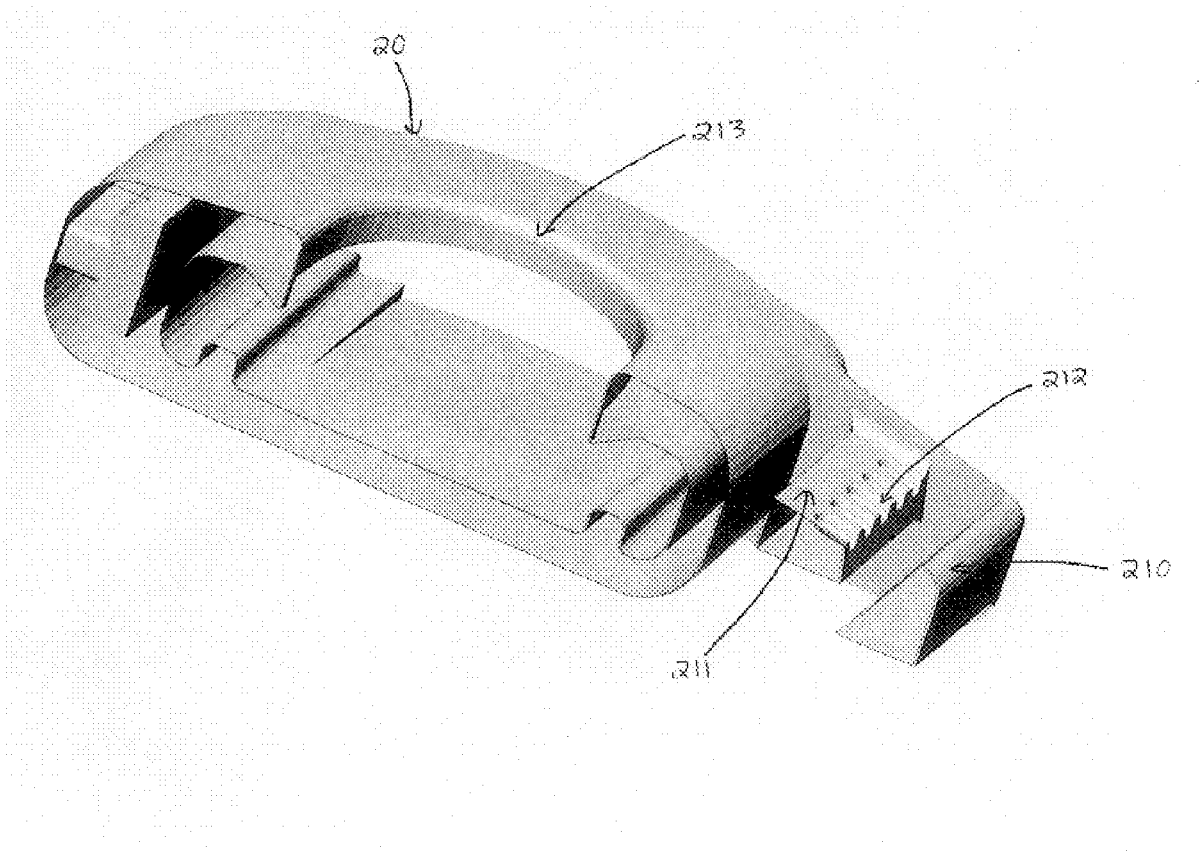
FIG. 8 shows an isometric section view of the first embodiment of the buckle body to illustrate the configuration of the buckle body strap-bar onto which a strap can be attached.
Figure 17:
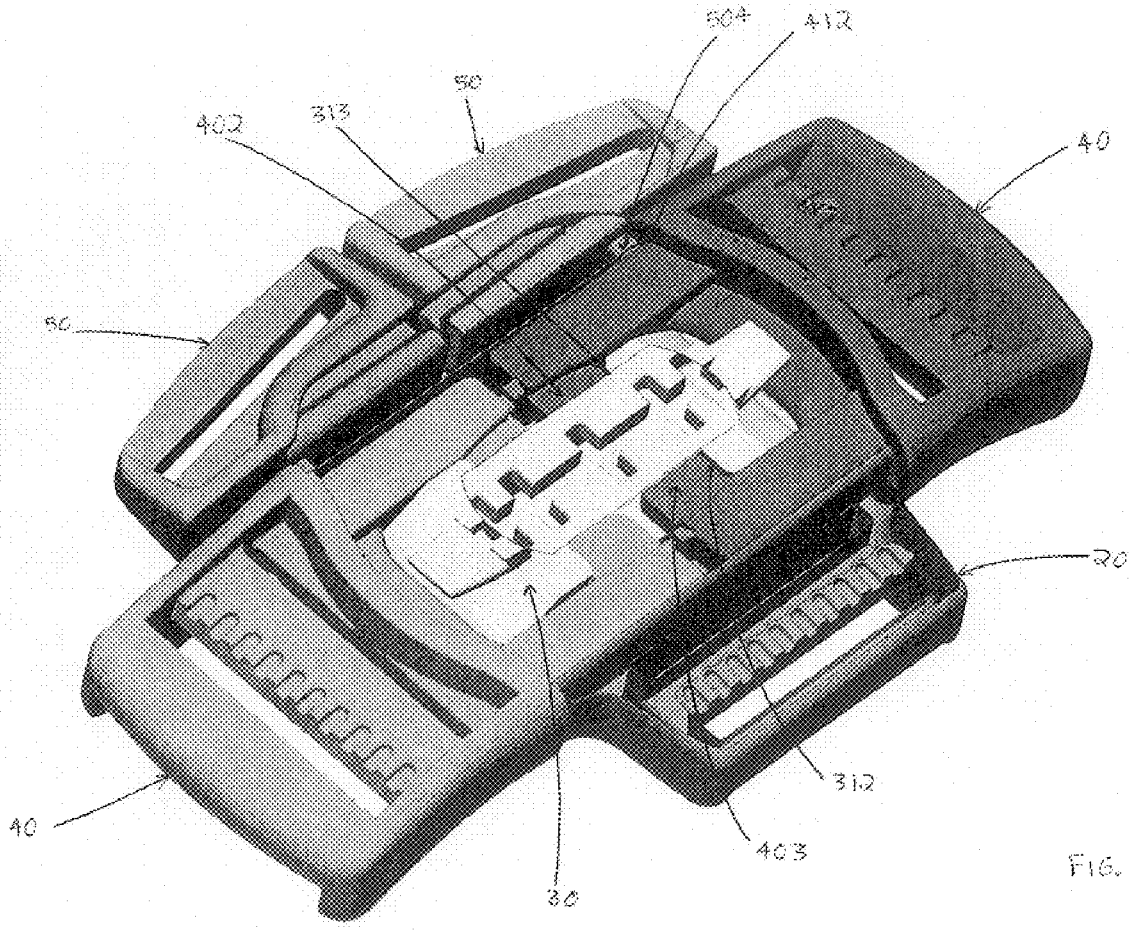
FIG. 17 shows a section view of the first embodiment of the three and five-point buckle assembly, in the five point mode, with the top surface of the buckle body member removed, an isometric section view of the release button, two side-tongue members, and two main-tongue members, to illustrate assembly of the components.

FIG. 3 shows an isometric view of the first embodiment of the buckle body illustrating the top surface 200. FIG. 4 shows an isometric section view of the first embodiment of the buckle body 20 with the top surface 200 removed. FIG. 5 shows an isometric view of the first embodiment of the buckle body illustrating the bottom surface 201. FIG. 6 shows an isometric section view of the first embodiment of the buckle body 20 with the bottom surface 201 removed. FIG. 7 shows an alternate isometric view of the first embodiment of the buckle body illustrating the top surface 200. FIG. 8 shows an isometric section view of the first embodiment of the buckle body 20 to illustrate the configuration of the buckle body strap-bar 211 onto which a strap can be attached. FIG. 17 shows a section view of the first embodiment of the three and five-point buckle assembly 10, in the five-point mode, with the top surface 200 of the buckle body member 20 removed, an isometric section view of the release button 30, two side-tongue members 50, and two main-tongue members 40, to illustrate assembly of the components. The buckle body 20 includes the following sub-components; a top surface 200, a bottom surface 201, side openings 202 and 203 for insertion of main-tongues 40, two protrusions 204 and 205, two guide tracks 206 and 207, four cutout edges 208, 209, 214 and 215, a cross-bar 210, a strap bar 211, teeth 212, a top opening 213 for access to release button 30, two channels 216 and 217 for insertion of side-tongues 50 (or 50'), two recesses 218 and 219 (not shown), two indentations 220 and 221, and rib 222 (not shown). The buckle body 20, functions as a housing for release button 30, side-tongues 50 (or 50'), and main-tongues 40, as shown in FIGS. 1A and 17. The buckle body 20 may be constructed from a variety of materials including, but not limited to, nylon, acetal, polypropylene, metals, or like materials with similar desired properties. A material such as nylon provides a flexible structure immediately after molding and prior to drying and provides for a rigid structure after drying, whereas a material such as acetal remains generally flexible. During assembly, it will be appreciated that the release button 30 could be preferably inserted into the side opening of a nylon buckle body 20 immediately after molding while the buckle body remains flexible to facilitate insertion.

Figure 9:
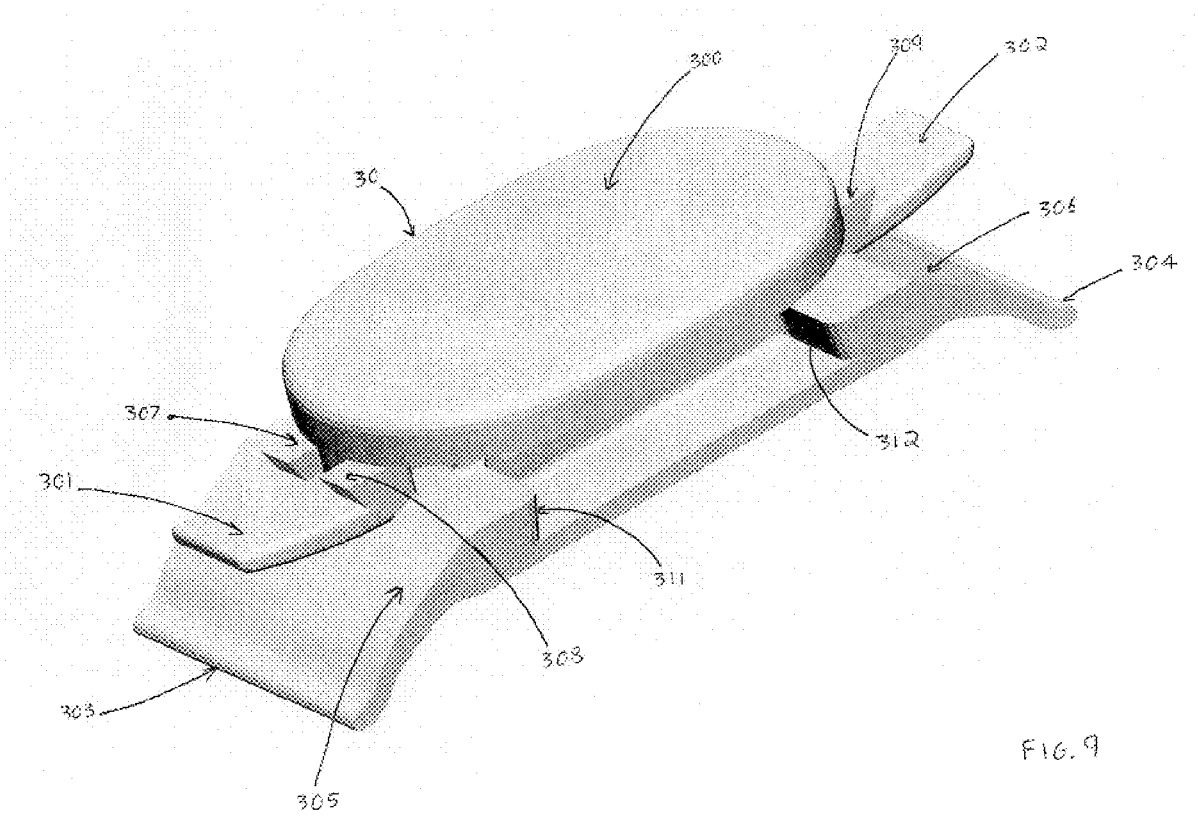
FIG. 9 shows an isometric view of a release button from the top.
Figure 10:
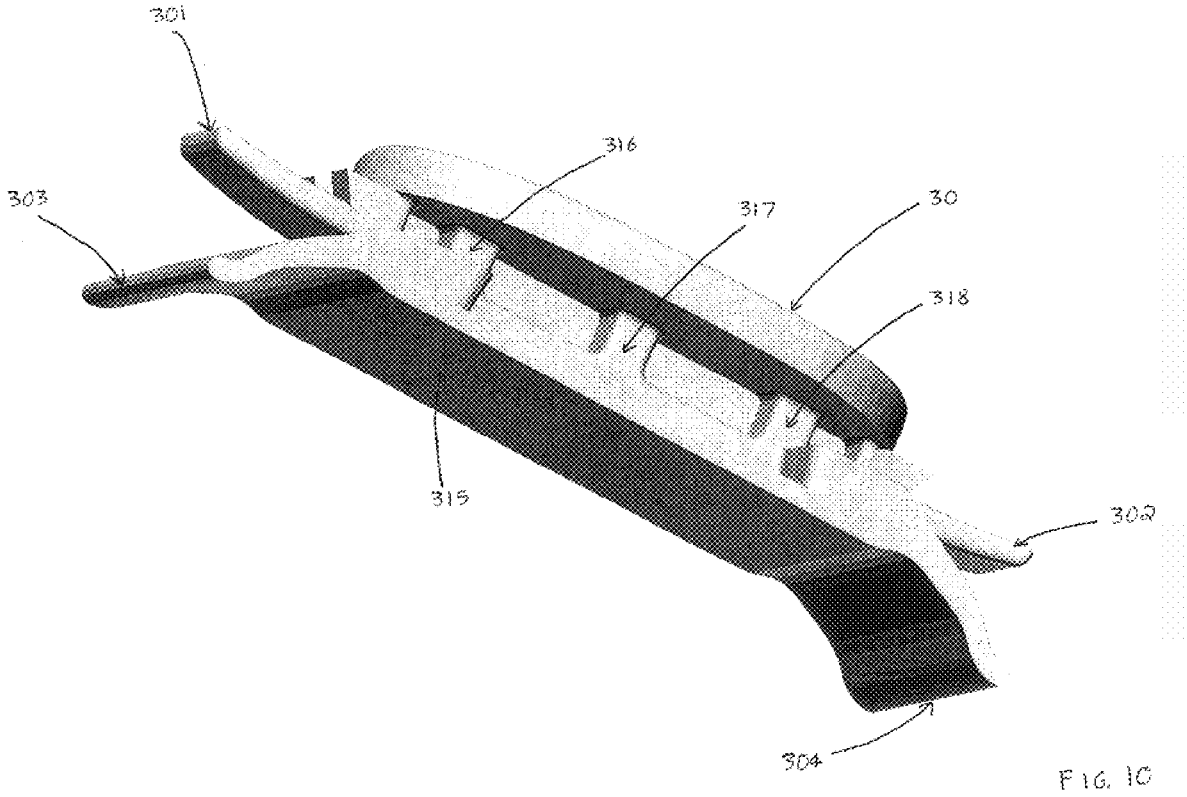
FIG. 10 shows an isometric view of the release button from the bottom.
Figure 11:
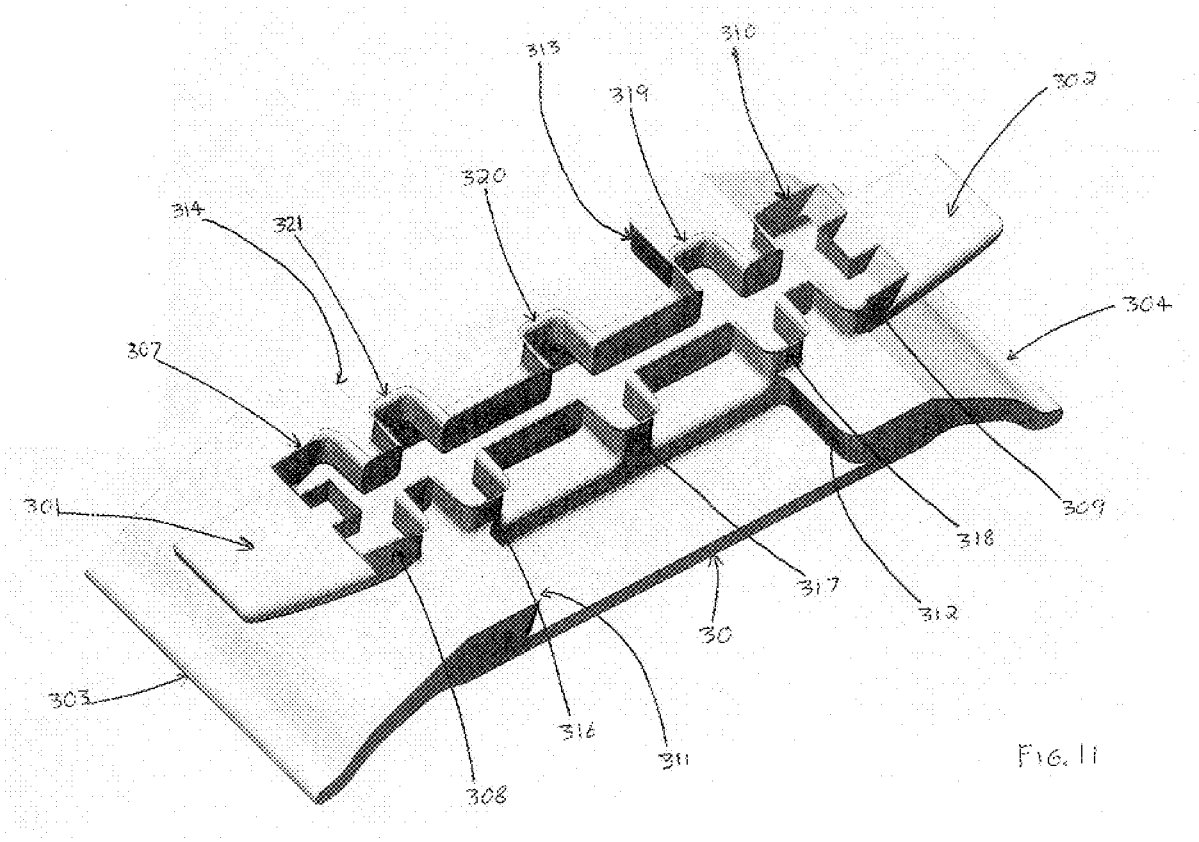
FIG. 11 shows an isometric section view of the release button to illustrate the latch members.

FIG. 9 shows an isometric view of the release button 30 from the top. FIG. 10 shows an isometric view of the release button 30 from the bottom. FIG. 11 shows an isometric section view of the release button 30 to illustrate the latch members. The release button 30 includes the following sub-components; a contoured top surface 300, a substantially flat bottom surface 315, two main-tongue ejection tabs 301 and 302, two release button biasing tabs 303 and 304, two ramp surfaces 305 and 306, four reinforcement indents (307–310), four main-tongue retaining latches (311–314), and six reinforcement ribs (316–321). The contoured top surface 300 of release button 30 can be provided with various textures, logos, or contours. To further facilitate operation of the three and five-point buckle assemblies 10 and 80, the release button 30 can also be provided with contrasting colors as compared to the other components of the three and five-point buckle assemblies 10 or 80. A tooling insert may be used to facilitate manufacture of the contoured top surface 300 of the release button 30. The release button 30 may be constructed from a variety of materials including, but not limited to, nylon, acetal, polypropylene, metals, or like materials with similar desired properties. Preferably, the release button 30 is constructed of acetal.

Figure 12:
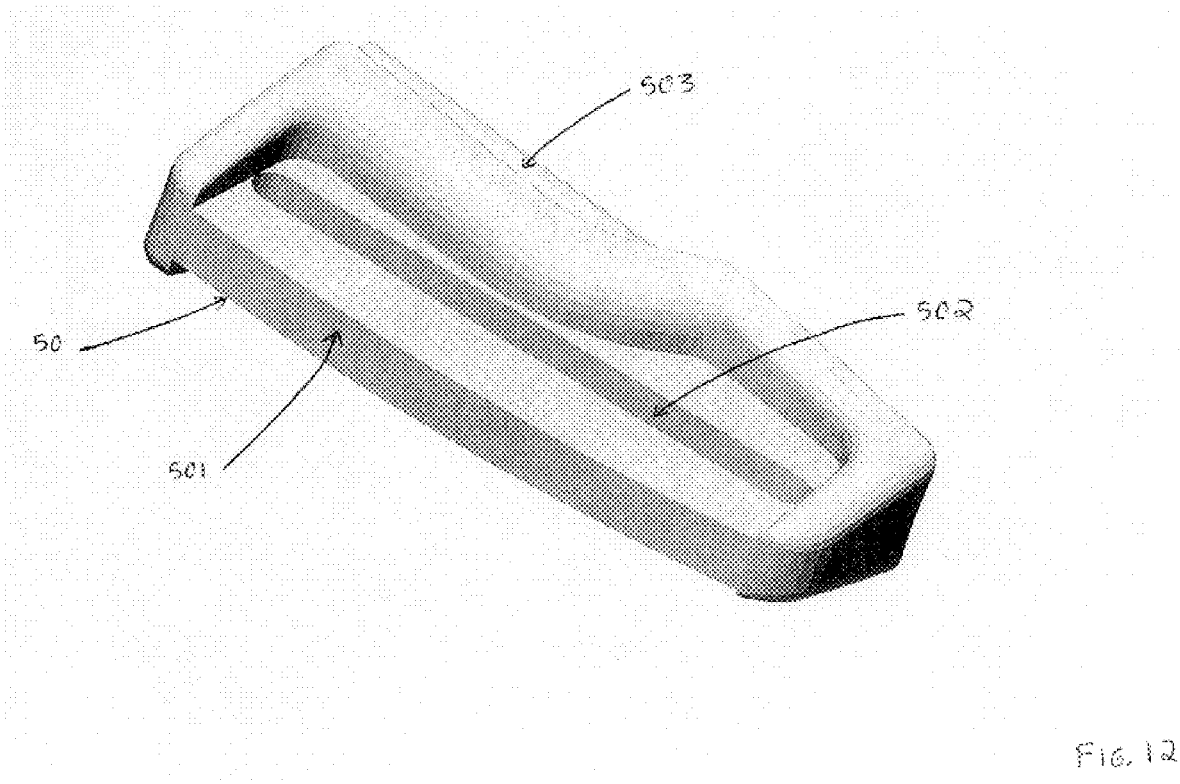
FIG. 12 shows an isometric view of a first embodiment of a side-tongue from above.
Figure 13:
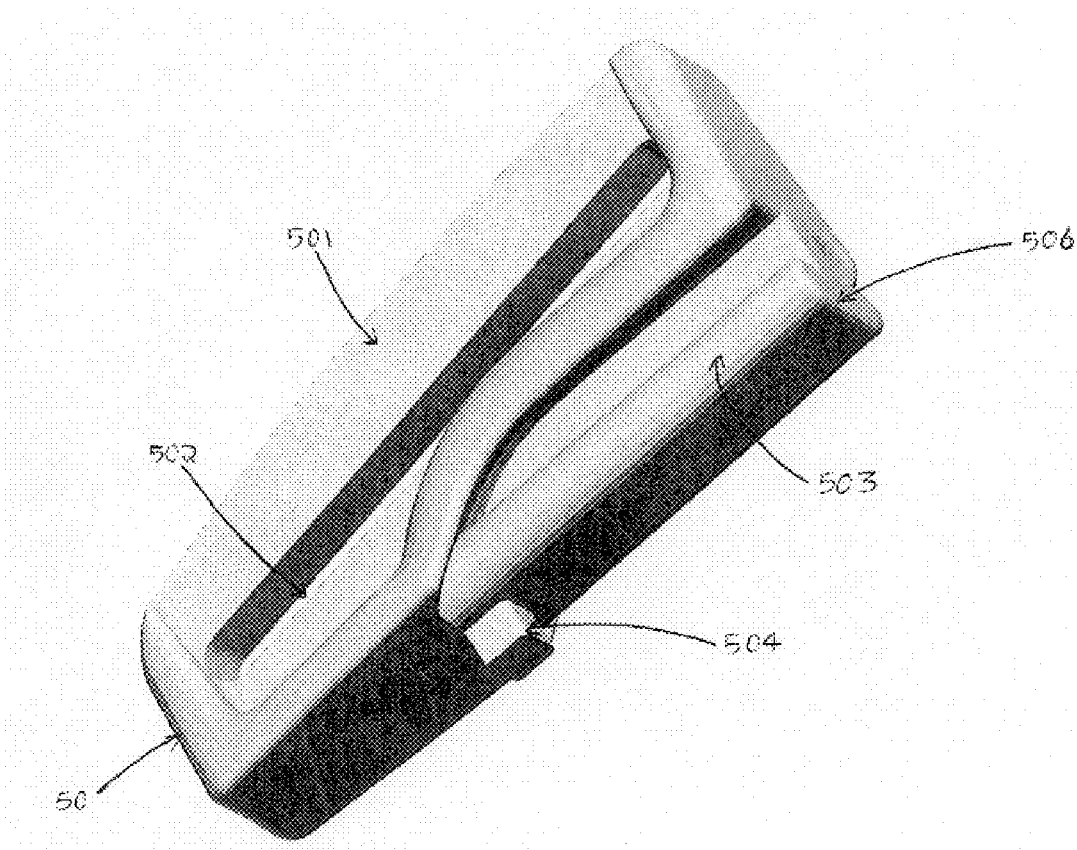
FIG. 13 shows an isometric view of the first embodiment of the side-tongue from below.
Figure 14A:
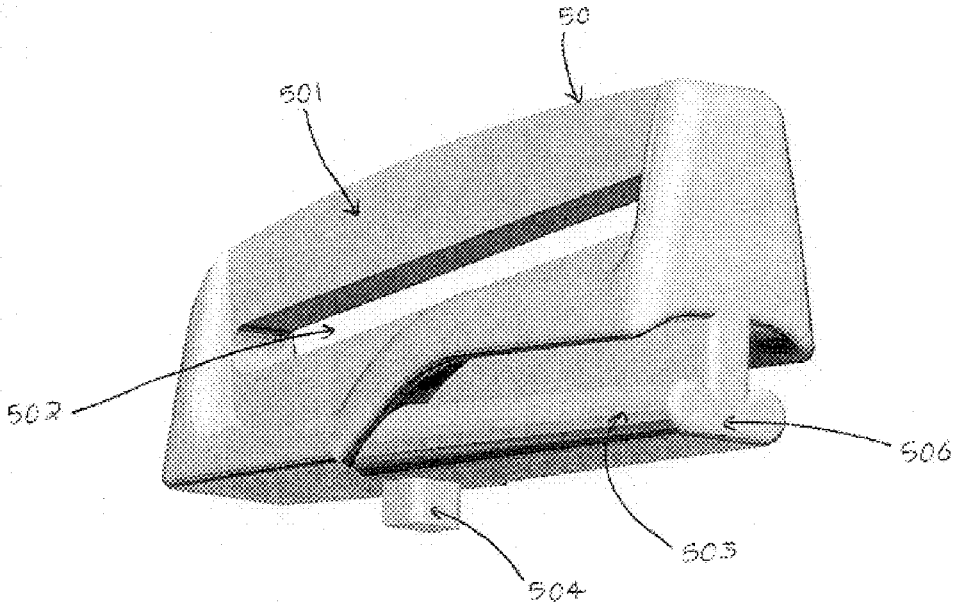
FIG. 14A shows an alternate isometric view of the first embodiment of the side-tongue.
Figure 14B:
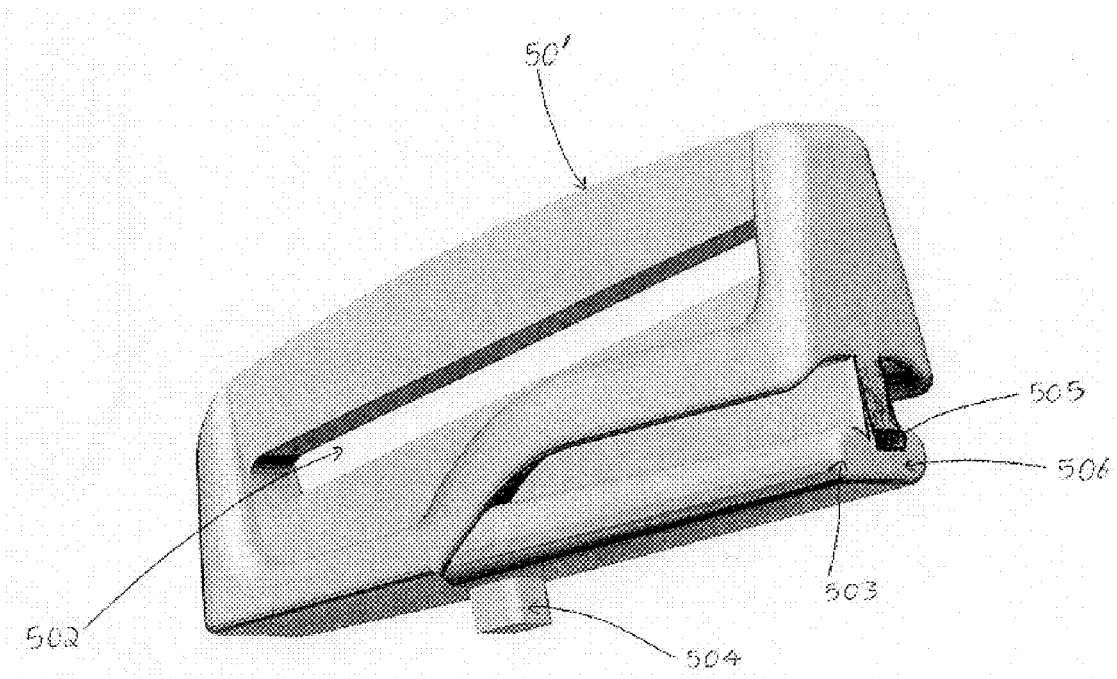
FIG. 14B shows an isometric view of a second embodiment of the side-tongue.

FIG. 12 shows an isometric view of the first embodiment of the side-tongue 50 from above. FIG. 13 shows an isometric view of the first embodiment of the side-tongue 50 from below. FIG. 14A shows an alternate isometric view of the first embodiment of the side-tongue 50. FIG. 14B shows an isometric view of the second embodiment of the side-tongue 50'. The side-tongue 50 includes the following sub-components; a strap-bar 501, a strap insertion region 502, a guide 503 and a stop 504. The: side-tongue 50' includes the following sub-components; a strap-bar 501, a strap insertion region 502, a guide 503, a stop 504, and a flex finger 505 on face 506. The side-tongues 50 (or 50') may be constructed from a variety of materials including, but not limited to nylon, acetal, polypropylene, metals, or like materials with similar desired properties. Preferably, the side-tongues 50 (or 50') are constructed of nylon.

Figure 15:
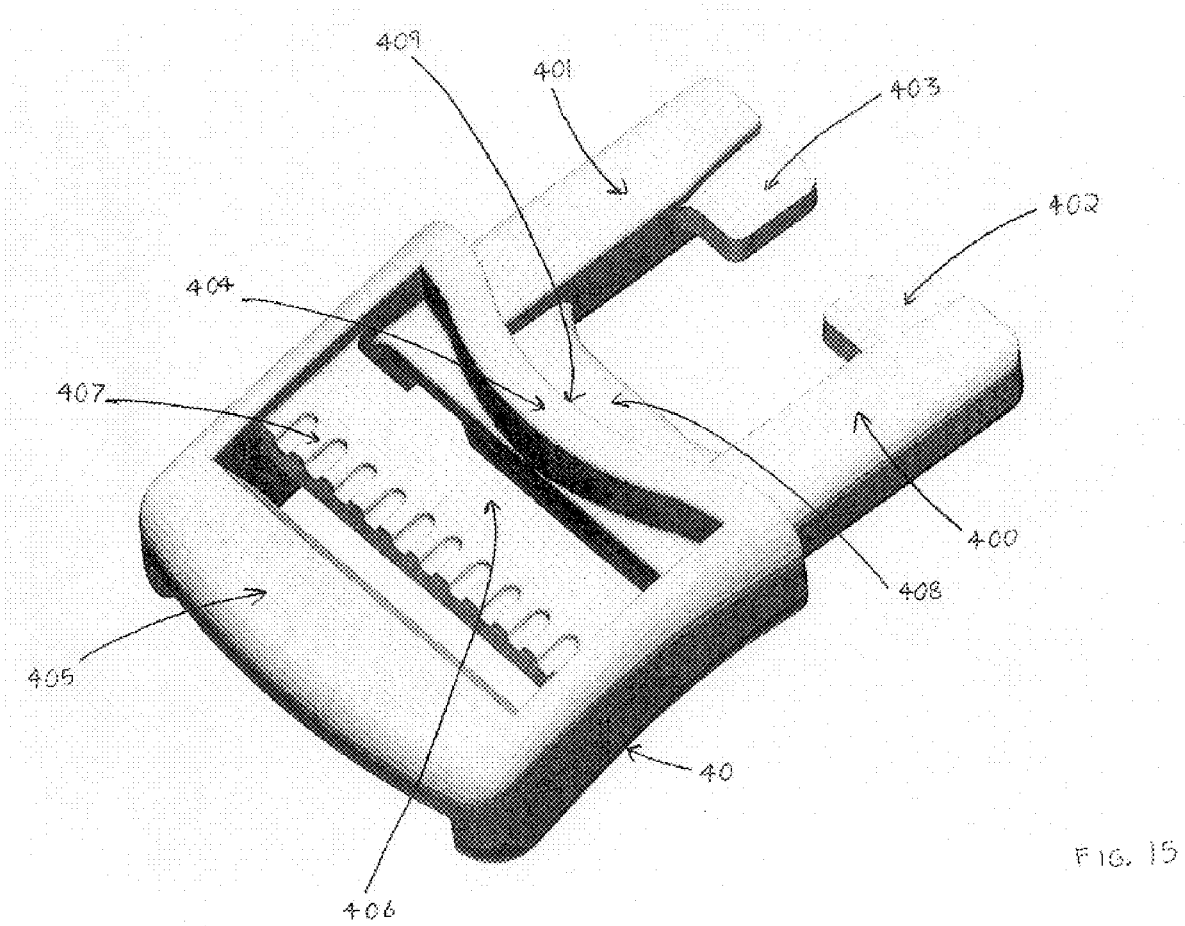
FIG. 15 shows an isometric view of a first embodiment of a main-tongue from above.
Figure 16:
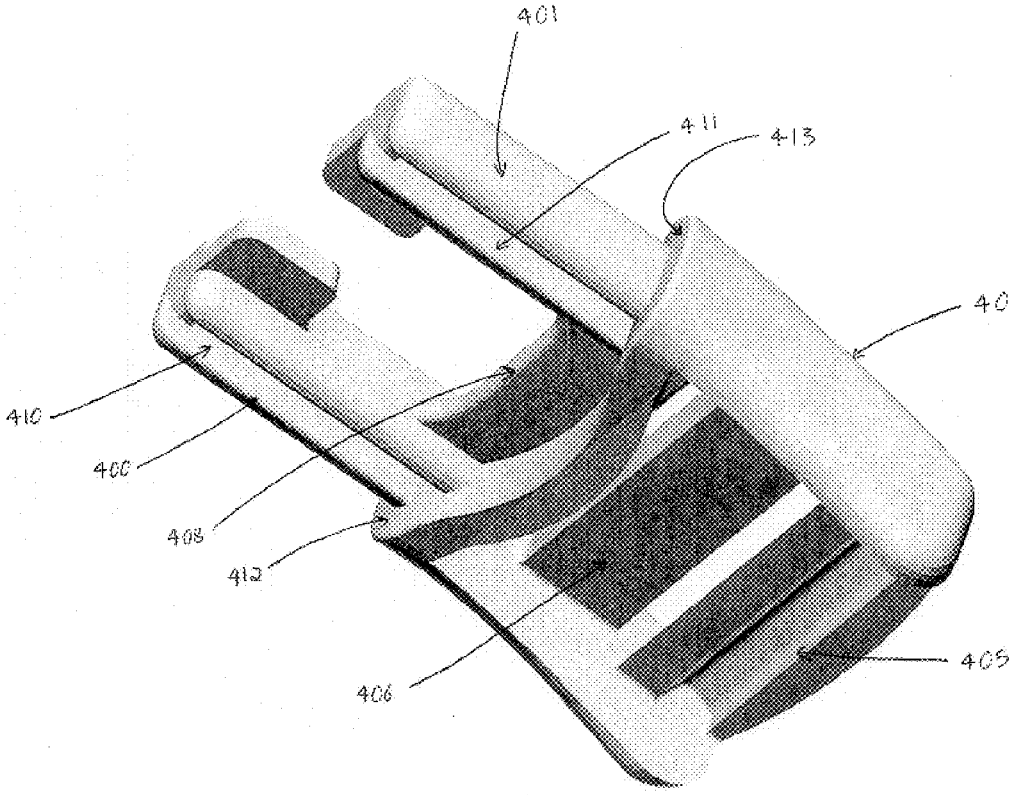
FIG. 16 shows an isometric view of the first embodiment of the main-tongue from below.

FIG. 15 shows an isometric view of the first embodiment of the main-tongue 40 from above. FIG. 16 shows an isometric view of the first embodiment of the main-tongue 40 from below. The main-tongue 40 includes the following sub-components; two arms 400 and 401, two locking prongs 402 and 403, three ribs 404, 405 and 406, teeth 407, a main-tongue ejection tab mating surface 408, a recess 409, two channels 410 and 411, and two stop-retaining surfaces 412 and 413. The main-tongue 40 may be constructed from a variety of materials including, but not limited to, nylon, acetal, polypropylene, metals, or like materials with similar desired properties. Preferably, the main-tongue 40 is constructed of nylon.

The construction and operation of the first embodiment of the three and five-point buckle assembly 10 will now be described in detail.

Referring to FIGS. 1A–17, for assembly and operation, the release button 30 is inserted into the buckle body 20 through one of the buckle body side openings 202 or 203 (direction A shown in FIG. 2). During insertion, the top and bottom surfaces 200 and 201, respectively, of buckle body 20 as well as the release button biasing tabs 303 and 304 elastically deform to allow release button 30 to be positioned into buckle body 20. Once positioned, the release button biasing tabs 303 and 304 bias the top surface 300 of release button 30 through top opening 213 of buckle body 20. Release button 30 is maintained in a substantially proper lateral alignment with respect to buckle body 20 by means of cutout edges 208, 209, 214 and 215, which bear against the lateral edges of tabs 303 and 304 of release button 30. Release button 30 is also maintained in the substantially proper lateral and a substantially proper vertical alignment with respect to buckle body 20 by means of indentations 220 and 221, which substantially prevent top surface 300 of release button 30 from being displaced out of top opening 213 of buckle body 20. After insertion and positioning of the release button 30 into the buckle body 20, as shown in FIGS. 1A–17, side-tongues 50 (or 50') are inserted into channels 216 and 217 of buckle body 20 such that stops 504 fit into recesses 218 and 219, respectively. The main-tongues 40 are then inserted through the side opening 202 or 203 of buckle body 20. Each of the main-tongues 40 are guided into one of the openings 202 or 203 of buckle body 20 by sliding engagement between channels 410 and 411 on main-tongues 40 and guide tracks 207 and 206 on buckle body 20, respectively. As each of the main-tongues 40 are inserted into buckle body 20, the locking prongs 402 and 403 on arms 400 and 401, respectively, slide on ramp surfaces 305 or 306, respectively, of release button 30. As the main-tongues 40 are further inserted, as shown in FIG. 17, the main-tongue ejection tab mating surface 408 on each respective main-tongue 40 is slid between the respective main-tongue ejection tabs 301 or 302, and the respective ramp surfaces 305 or 306 on release button 30. As the main-tongues 40 are fully inserted into buckle body 20, the respective protrusions 204 or 205 on buckle body 20 come into mating engagement with the recess 409 on main-tongues 40. At this point, the locking prongs 402 and 403 on main-tongues 40 engage the respective main-tongue retaining latches (311–314) on the release button 30. Thus the main-tongues 40 are locked into place by means of a mating engagement with release button 30. Once the main-tongues 40 are locked into place, stop retaining surfaces 412 and 413 on main-tongues 40 bear against stop 504 on the respective side-tongues 50 (or 50'), and thus prevent side-tongues 50 (or 50') from being removed.

In order to release main and side-tongues 40 and 50 (or 50'), respectively, from the buckle body 20, the release button 30 is simply depressed against the upwards bias of release button biasing tabs 303 and 304. Once the release button 30 is depressed, the main-tongue ejection tabs 301 and 302 aid in ejection of main-tongues 40 by providing an outward biasing force in the direction opposite to the insertion direction of main-tongues 40. Upon release of main-tongues 40, side-tongues 50 (or 50') can be removed from channels 216 and 217 of buckle body 20. It should be noted that if side-tongues 50' are used instead of side-tongues 50 for the three and five-point assembly 10, the flex fingers 505 on side-tongues 50', which are compressed against rib 222 (not shown) of buckle body 20 after assembly, will aid in the ejection of side-tongues 50' from channels 216 and 217 of buckle body 20.

In operation, a conventional strap (not shown) can be attached to strap bar 211 of buckle body 20. Similarly, a conventional strap (not shown) can be attached to rib 406 of each of the respective main-tongues 40, and strap-bar 501 of each of the respective side-tongues 50 (or 50'). In order to adjust the length of the straps (not shown), the buckle body 20 can be translated relative to the strap attached to strap bar 211. The teeth 212 on the strap bar 211 as well as the edges of the strap bar prevent translation of the buckle body 20 relative to the strap when the strap is placed in tension. The straps attached to the rib 406 of the main-tongues 40 can be adjusted in a similar manner as the straps attached to the buckle body 20. For the straps attached to the side-tongues 50 (or 50') however, the straps can be sewn to the strap-bar 501 at a pre-determined length, or a conventional strap adjuster (not shown) can be used to adjust the length of the strap relative to the side-tongues 50 (or 50'). After adjustment of the straps, each of the side-tongues 50 (or 50') can be inserted into channels 216 and 217 of buckle body 20, as shown in FIG. 17. Next, each of the main-tongues 40 can be inserted into buckle body 20 through the respective openings 202 or 203 to engage with the respective main-tongue retaining latches of the release button 30. The three and five-point buckle assembly 10 has the fully-assembled configuration shown in FIG. 1A. For releasing the tongues 40 and 50 (or 50'), as discussed previously, the release button is depressed in a direction substantially opposite to the bias of release button biasing tabs 303 and 304, and the main-tongues 40 are released from the respective openings 202 or 203 of the buckle body 20. Removal of main-tongues 40 also allows removal of side-tongues 50 (or 50'). The strap-bar 211 with teeth 212 and cross-bar 210 on the buckle body 20, function as a "multi-bar webbing lock" and provide a means for preventing unnecessary movement of the straps attached to the buckle body 20. Similarly, rib 406 with teeth 407 and rib 405 on each of the main-tongues 40, function as a "multi-bar webbing lock" and provide a means for preventing unnecessary movement of the straps attached to the main tongues 40.

It should be noted that the operation of the three and five-point buckle assembly 80 is substantially similar to the operation of assembly 10, except that the assembly 80 only uses the main-tongues 40 (not the side-tongues 50 or 50'), constituting the three-point mode as explained above. It will be further appreciated that the preferred three and five-point buckle design of the present invention only places a tensile force on the locking prongs 402 and 403 of the main tongues 40 and the main-tongue retaining latches (311–314) of the release button 30, respectively. During insertion and latching, the main-tongues 40 are inserted into buckle body 20 without any deflection of the arms 400 and 401, locking prongs 402 or 403 of the main tongues 40, or the main-tongue retaining latches (311–314) of the release button 30.

Next, the third embodiment of the three and five-point buckle assembly of the present invention will be described in detail.

Figure 18:
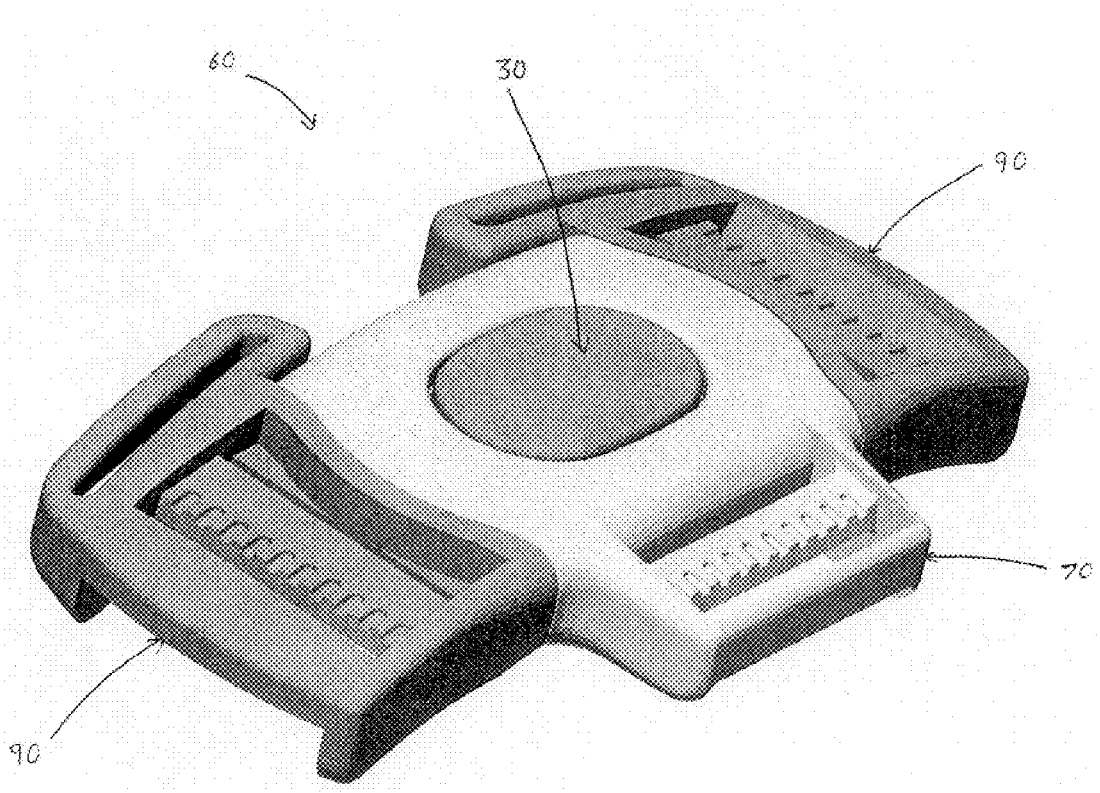
FIG. 18 shows an isometric view of a third embodiment of the three and five-point buckle assembly of the present invention in the assembled configuration.

FIG. 18 shows an isometric view of the third embodiment of the three and five-point buckle assembly 60. The three and five-point buckle assembly 60 preferably includes the following components; a buckle body 70, a release button 30, and two mirror image main tongues 90. It should be noted that the preferred release button 30 for the three and five-point buckle assembly 60 is identical to the release button used for three and five-point buckle assemblies 10 and 80.

Each of the components of the third embodiment of the three and five-point buckle assembly 60 will now be explained in detail.

Figure 19:
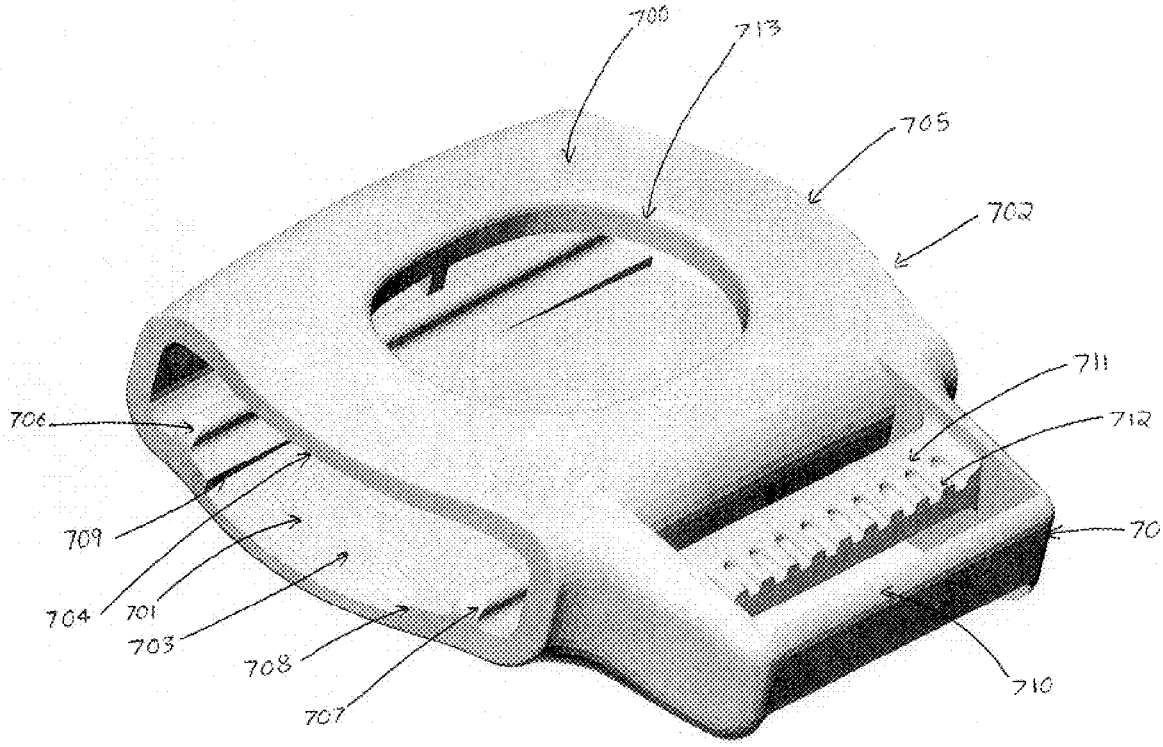
FIG. 19 shows an isometric view of a second embodiment of the buckle body illustrating the top surface.
Figure 20:
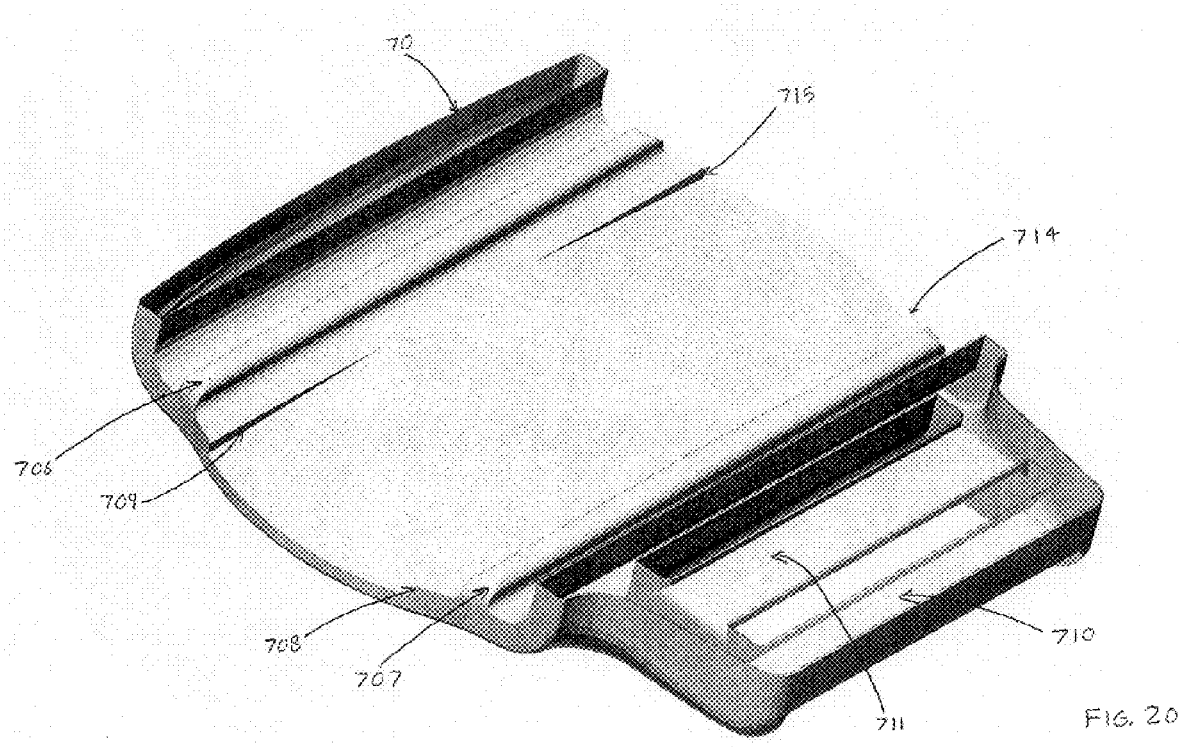
FIG. 20 shows an isometric section view of the second embodiment of the buckle body with the top surface removed.
Figure 21:
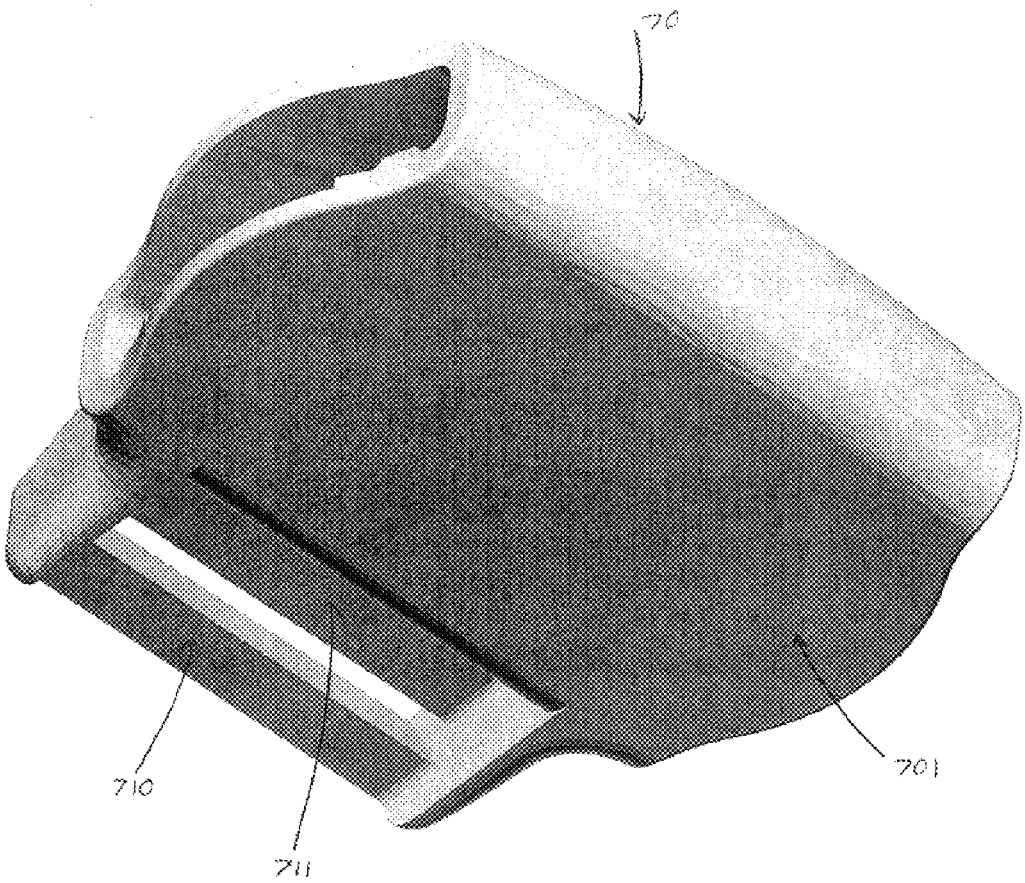
FIG. 21 shows an isometric view of the second embodiment of the buckle body illustrating the bottom surface.
Figure 22:
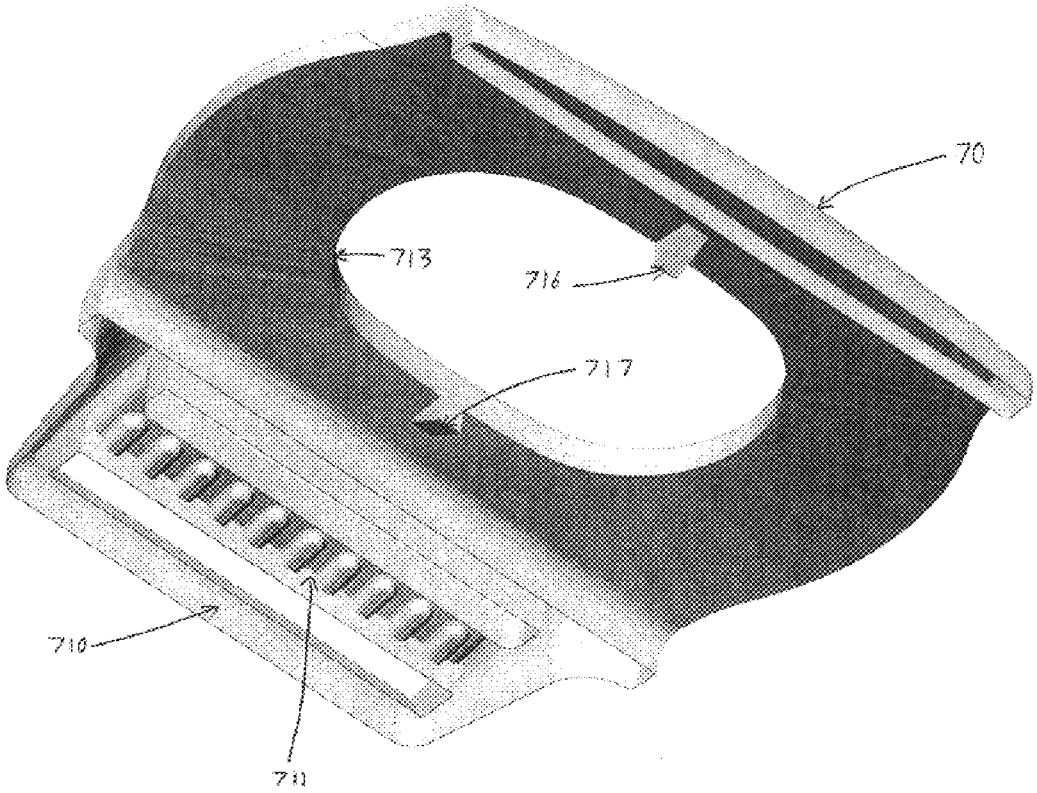
FIG. 22 shows an isometric section view of the second embodiment of the buckle body with the bottom surface removed.
Figure 23:
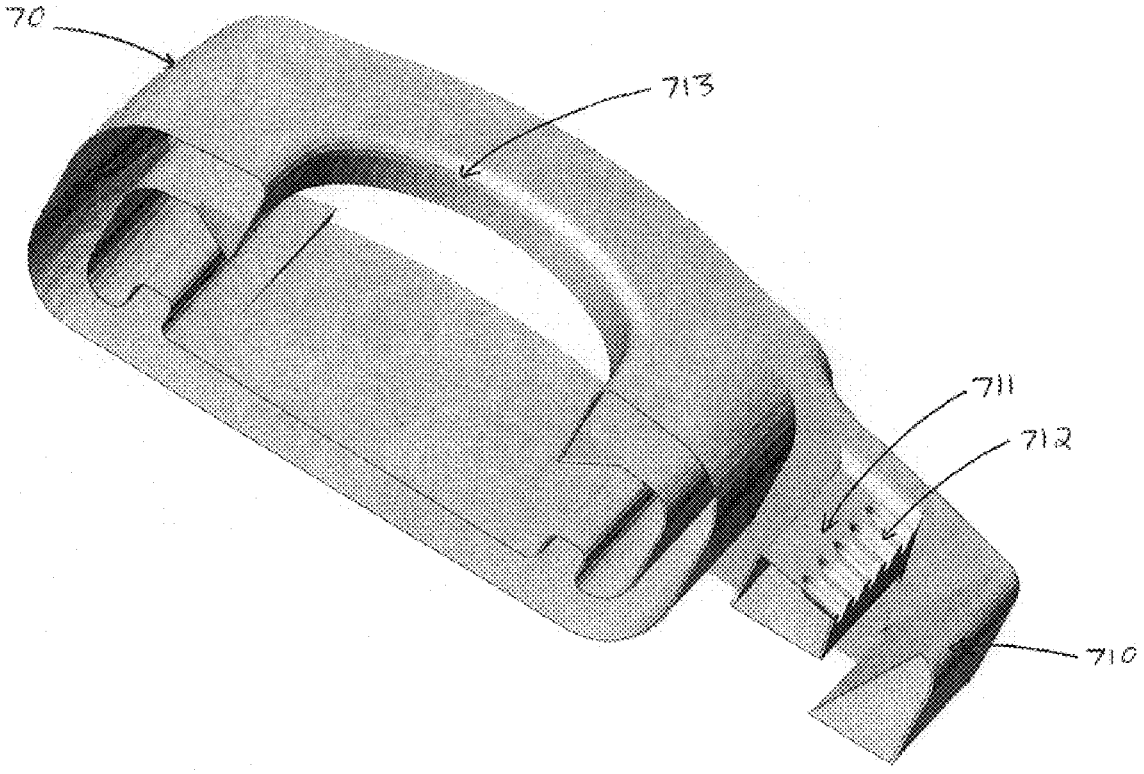
FIG. 23 shows an isometric section view of the second embodiment of the buckle body to illustrate the configuration of the buckle body strap-bar onto which a strap can be attached.
Figure 26:
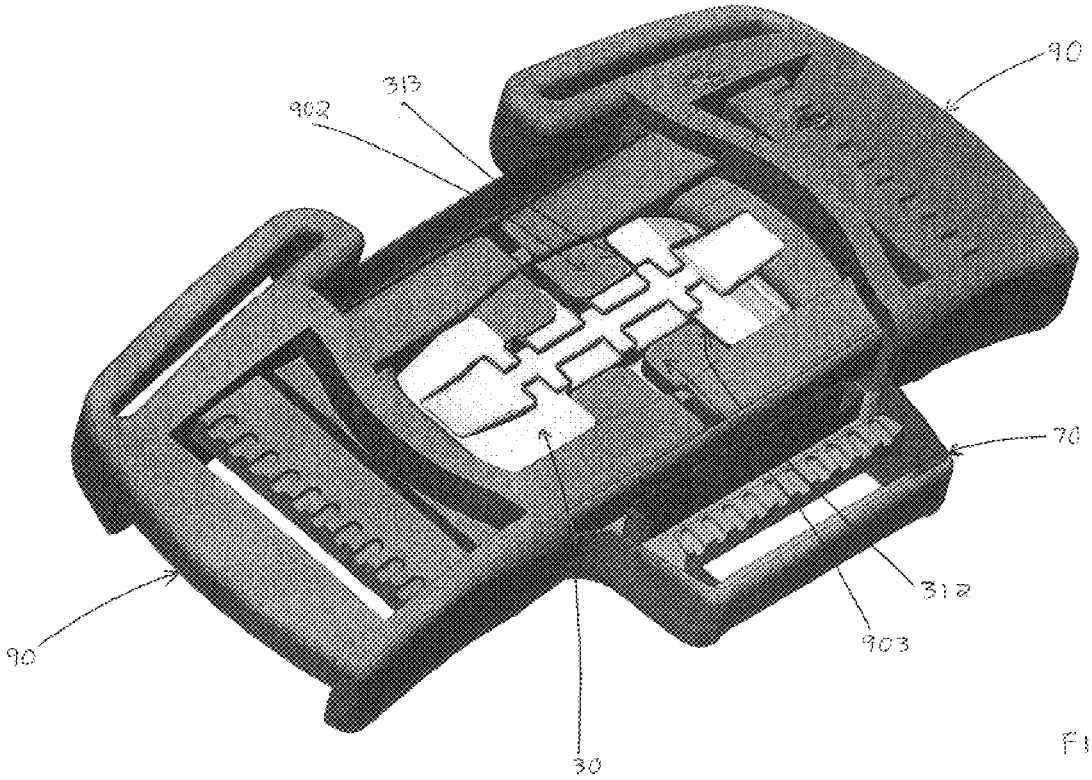
FIG. 26 shows a section view of the third embodiment of the three and five-point buckle assembly with the top surface of the buckle body member removed, an isometric section view of the release button, and two main-tongue members, to illustrate assembly of the components.

FIG. 19 shows an isometric view of the second embodiment of the buckle body illustrating the top surface 700. FIG. 20 shows an isometric section view of the second embodiment of the buckle body 70 with the top surface 700 removed. FIG. 21 shows an isometric view of the second embodiment of the buckle body illustrating the bottom surface 701. FIG. 22 shows an isometric section view of the second embodiment of the buckle body 70 with the bottom surface 701 removed. FIG. 23 shows an isometric section view of the second embodiment of the buckle body 70 to illustrate the configuration of the buckle body strap-bar 711 onto which a strap can be attached. FIG. 26 shows a section view of the third embodiment of the three and five-point buckle assembly 60 with the top surface 700 of the buckle body member 70 removed, an isometric section view of the release button 30, and two main-tongue members 90, to illustrate assembly of the components. The buckle body 70 includes the following sub-components; a top surface 700, a bottom surface 701, side openings 702 and 703 for insertion of main-tongues 90, two protrusions 704 and 705, two guide tracks 706 and 707, four cutout edges 708, 709, 714 and 715, a cross-bar 710, a strap bar 711, teeth 712, a top opening 713 for access to release button 30, and indentations 716 and 717. The buckle body 70 functions as a housing for release button 30 and main-tongues 90, as shown in FIG. 26. The buckle body 70 may be constructed from a variety of materials including, but not limited to, nylon, acetal, polypropylene, metals, or like materials with similar desired properties. A material such as nylon provides for an initially flexible and then ultimately rigid structure after drying, whereas a material such as acetal allows for uniform flexibility in a structure, as noted above.

Figure 24:
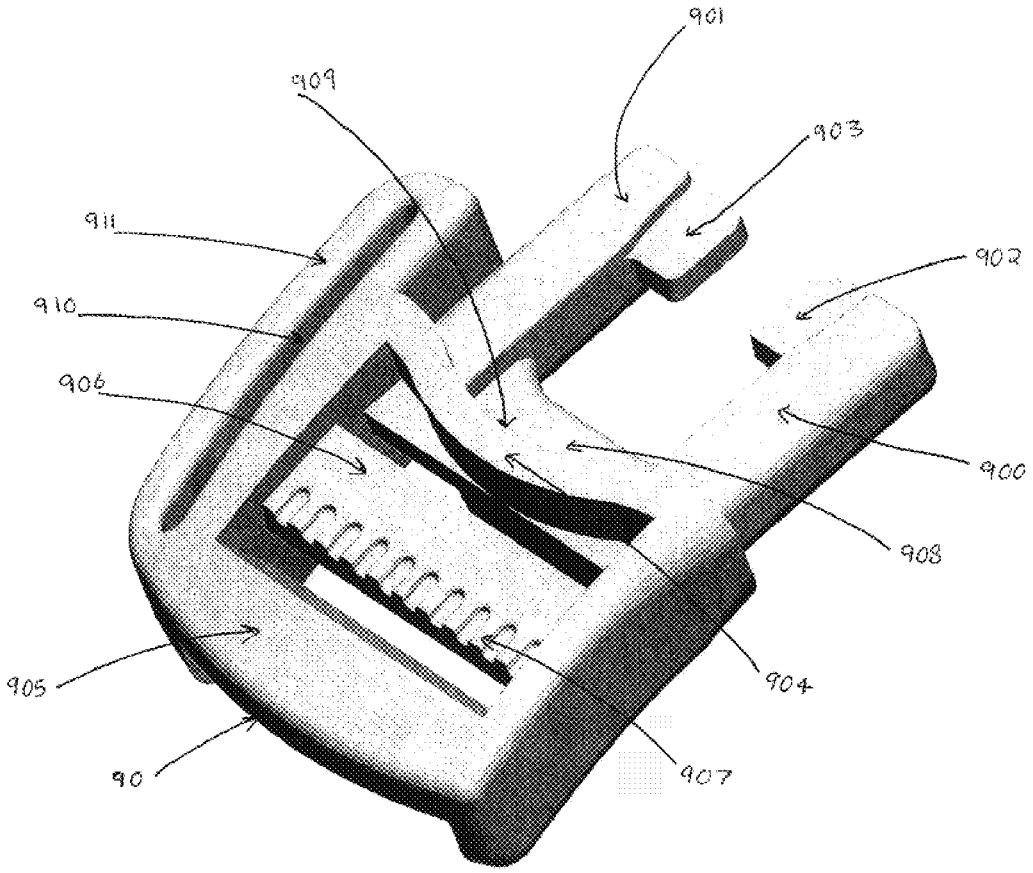
FIG. 24 shows an isometric view of a second embodiment of the main-tongue from above.
Figure 25:
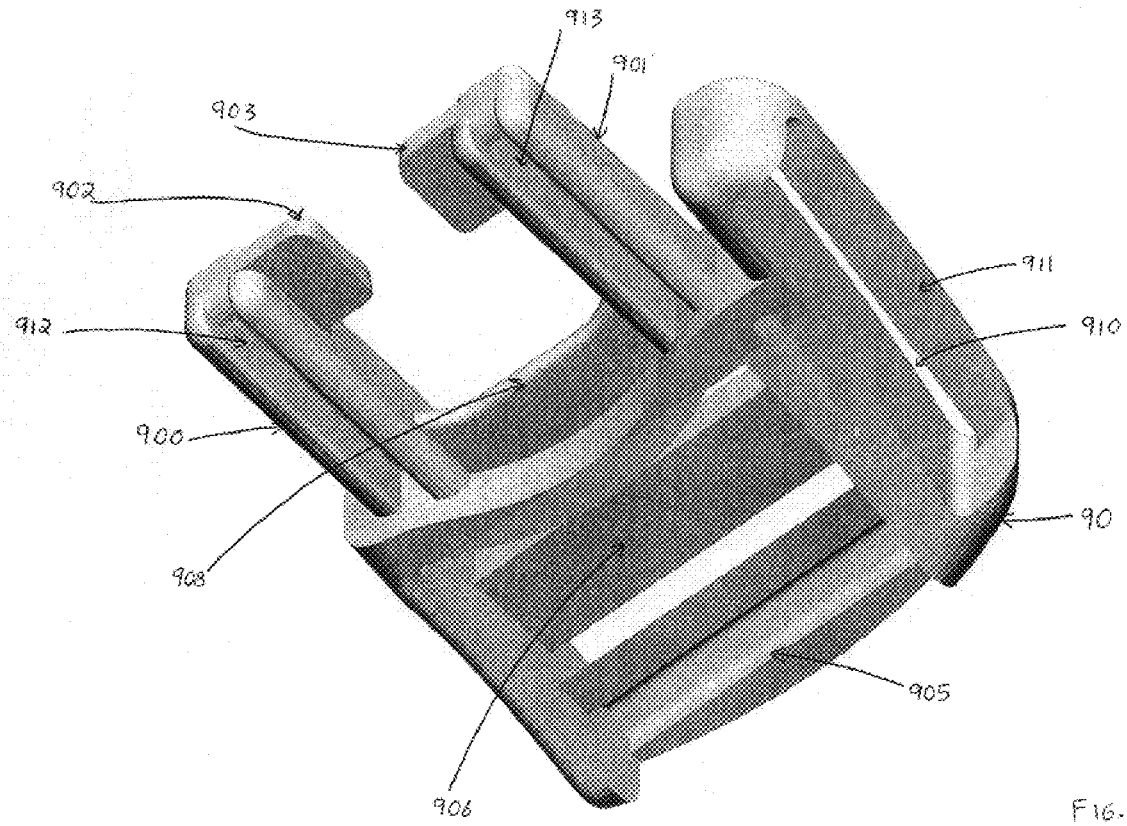
FIG. 25 shows an isometric view of the second embodiment of the main-tongue from below.

FIG. 24 shows an isometric view of the second embodiment of the main-tongue 90 from above. FIG. 25 shows an isometric view of the second embodiment of the main-tongue 90 from below. The main-tongue 90 includes the following sub-components; two arms 900 and 901, two locking prongs 902 and 903, three ribs 904, 905 and 906, teeth 907, a main-tongue ejection tab mating surface 908, a recess 909, a transverse strap channel 910, a transverse strap bar 911, and two channels 912 and 913. The main-tongue 90 may be constructed from a variety of materials including, but not limited to, nylon, acetal, polypropylene, metals, or like materials with similar desired properties. Preferably, the main-tongue 90 is constructed of nylon.

It should be noted that the three and five-point buckle assembly 60 operates in a five-point mode when conventional straps (not shown) are attached to each of the respective ribs 906 and the transverse strap bars 911 of the main-tongues 90. Similarly, the three and five-point buckle assembly 60 operates in a three-point mode when conventional straps (not shown) are only attached to the respective ribs 906, or the transverse strap bars 911, of the main-tongues 90.

The construction and operation of the third embodiment of the three and five-point buckle assembly 60 will now be described in detail.

Referring to FIGS. 18–26, for assembly and operation, the release button 30 is inserted into the buckle body 70 through one of the buckle body side openings 702 or 703. During insertion, the top and bottom surfaces 700 and 701, respectively, of buckle body 70 as well as the release button biasing tabs 303 and 304 elastically deform to allow release button 30 to be positioned into buckle body 70. Once positioned, the release button biasing tabs 303 and 304 bias the top surface 300 of release button 30 through top opening 713 of buckle body 70. Release button 30 is maintained in a substantially proper lateral alignment with respect to buckle body 70 by means of cutout edges 708, 709, 714 and 715, which bear against the lateral edges of tabs 303 and 304 of release button 30. Release button 30 is also maintained in the substantially proper lateral and a substantially proper vertical alignment with respect to buckle body 70 by means of indentations 716 and 717, which substantially prevent top surface 300 of release button 30 from being displaced out of top opening 713 of buckle body 70. After insertion and positioning of the release button 30 into the buckle body 70, as shown in FIGS. 18 and 26, main tongues 90 are inserted through the side opening 702 or 703 of buckle body 70. Each of the main-tongues 90 are guided into one of the openings 702 or 703 of buckle body 70 by sliding engagement between channels 912 and 913 on main-tongues 90 and guide tracks 707 and 706 on buckle body 70, respectively. As each of the main-tongues 90 are inserted into buckle body 70, the locking prongs 902 and 903 on arms 900 and 901, respectively, slide on ramp surfaces 305 or 306, respectively, of release button 30. As the main-tongues 90 are further inserted, as shown in FIG. 26, the main-tongue ejection tab) mating surface 908 on each respective main-tongue 90 is slid between the respective main-tongue ejection tabs 301 or 302, and the respective ramp surfaces 305 or 306 on release button 30. As the main-tongues 90 are fully inserted into buckle body 70, the respective protrusions 704 or 705 on buckle body 70 come into mating engagement with the recess 909 on main-tongues 90. At this point, the locking prongs 902 and 903 on main-tongues 90 engage the respective main-tongue retaining latches (311–314) on the release button 30. Thus the main-tongues 90 are locked into place by means of a mating engagement with release button 30.

In order to release main-tongues 90 from the buckle body 70, the release button 30 is simply depressed against the upwards bias of release button biasing tabs 303 and 304. Once the release button 30 is depressed, the main-tongue ejection tabs 301 and 302 aid in ejection of main tongues 90 by providing an outward biasing force in the direction opposite to the insertion direction of main-tongues 90.

In operation, a conventional strap (not shown) can be attached to strap bar 711 of buckle body 70. Similarly, a conventional strap (not shown) can be attached to rib 906 and transverse strap bar 911 of each of the respective main-tongues 90. In order to adjust the length of the straps (not shown), the buckle body 70 can be translated relative to the strap attached to strap bar 711. The teeth 712 on the strap bar 711 as well as the edges of the strap bar prevent translation of the buckle body 70 relative to the strap when the strap is placed in tension. The straps attached to the rib 906 of the main-tongues 90 can be adjusted in a similar manner as the straps attached to the buckle body 70. For the straps attached to the transverse strap bar 911 however, the straps can be sewn to the strap-bar 911 at a pre-determined length, or a conventional strap adjuster (not shown) can be used to adjust the length of the strap relative to the main-tongues 90. After adjustment of the straps, each of the main-tongues 90 can be inserted into buckle body 70 through the respective openings 702 or 703 to engage with the respective main-tongue retaining latches of the release button 30, as shown in FIG. 26. The three and five-point buckle assembly 60 has the fully-assembled configuration shown in FIG. 18. For releasing the main-tongues 90, as discussed previously, the release button is depressed in a direction substantially opposite to the upwards bias of release button biasing tabs 303 and 304, and the main-tongues 90 are released from the respective openings 702 or 703 of the buckle body 70. The strap-bar 711 with teeth 712 and cross-bar 710 on the buckle body 70, function as a "multi-bar webbing lock" and provide a means for preventing unnecessary movement of the straps attached to the buckle body 70. Similarly, rib 906 with teeth 907 and rib 905 on each of the main-tongues 90, function as a "multi-bar webbing lock" and provide a means for preventing unnecessary movement of the straps attached to the main-tongues 90.

It will be appreciated that the preferred three and five-point buckle design of the present invention only places a tensile force on the locking prongs 902 and 903 of the main-tongues 90 and the main-tongue retaining latches (311–314) of the release button 30, respectively. Furthermore, during insertion and latching, the main-tongues 90 are inserted into buckle body 70 without any deflection of the arms 900 and 901, locking prongs 902 or 903 of the main tongues 90, or the main-tongue retaining latches (311–314) of the release button 30.

It will also be appreciated that the design of the various components of the three and five-point buckle assemblies 10, 60 and 80, respectively, disclosed above were chosen to maximize conformation with industry test standards for buckles. Examples of such standards include standards to prevent finger catching or finger pinching within the components of the buckle assemblies.

While the inventions have been illustrated in detail and with reference to specific embodiments thereof, it will be apparent to one skilled in the art that various changes and modifications can be made therein without departing from the spirit and scope thereof. Thus, it is intended that the present inventions surface the modifications and variations of these inventions as would be apparent to those skilled in the art.

What is claimed is:

1. A multi-point buckle assembly comprising:

a body including a top opening on a top surface, a plurality of side openings, and a plurality of channels;

a release button disposed within the top opening including a first surface formed on one or more retaining latches; and a plurality of main tongues, one having a second surface to engage with the first surface of the release button, wherein the plurality of side openings and the plurality of channels are formed in different planes and each of the plurality of main tongues is adapted to fit into each of the plurality of side openings.

2. A multi-point buckle assembly comprising:

a body including a top opening on a top surface, a plurality of side openings, and a plurality of channels;

a release button disposed within the top opening including a first surface; and a plurality of main tongues, one having a second surface formed on a plurality of locking prongs to engage with the first surface of the release button, wherein the plurality of side openings and the plurality of channels are formed in different planes and each of the plurality of main tongues is adapted to fit into each of the plurality of side openings.

3. A multi-point buckle assembly comprising:

a body including a top opening on a top surface, a plurality of side openings, and a plurality of channels;

a release button disposed within the top opening including a first surface;

a plurality of side tongues, each of the plurality of side tongues is adapted to fit into one of the plurality of channels; and a plurality of main tongues, one having a second surface to engage with the first surface of the release button, wherein one of the plurality of main tongues provides a multi-bar webbing lock with a plurality of substantially parallel arms and a teeth formed between the plurality of substantially parallel arms, and wherein the multi-bar webbing lock prevents unnecessary movement of straps attached to each of the plurality of main tongues, wherein the plurality of side openings and the plurality of channels are formed in different planes and each of the plurality of main tongues is adapted to fit into each of the plurality of side openings.

4. A multi-point buckle assembly comprising:

a body including a top opening on a top surface, a plurality of side openings, and a plurality of channels;

a release button disposed within the top opening including a first surface;

a plurality of side tongues, each of the plurality of side tongues is adapted to fit into one of the plurality of channels; and a plurality of main tongues, one having a second surface to engage with the first surface of the release button, wherein one of the plurality of main tongues includes a plurality of locking prongs having the second surfaces and formed on a plurality of substantially parallel arms, wherein the plurality of side openings and the plurality of channels are formed in different planes and each of the plurality of main tongues is adapted to fit into each of the plurality of side openings.

5. The multi-point buckle assembly according to claim 4, wherein the plurality of locking prongs engage a plurality of retaining latches having the first surfaces and formed on the release button.

6. The multi-point buckle assembly according to claim 5, wherein one of the plurality of main tongues is inserted into the body without deflection of the plurality of substantially parallel arms, the plurality of locking prongs, or the plurality of retaining latches.

7. A multi-point buckle assembly comprising:

a body including a top opening on a top surface, a plurality of side openings, a plurality of channels, and a multi-bar webbing lock with a plurality of substantially parallel arms and a teeth formed between the plurality of substantially parallel arms, wherein the multi-bar webbing lock prevents unnecessary movement of straps attached to the body;

a release button disposed within the top opening including a first surface;

a plurality of side tongues, each of the plurality of side tongues is adapted to fit into one of the plurality of channels; and a plurality of main tongues, one having a second surface to engage with the first surface of the release button, wherein the plurality of side openings and the plurality of channels are formed in different planes and each of the plurality of main tongues is adapted to fit into each of the plurality of side openings.

8. A multi-point buckle assembly comprising:

a body including a top opening on a top surface and a plurality of side openings;

a release button disposed within the top opening; and a plurality of main tongues, wherein one of the plurality of main tongues provides a multi-bar webbing lock with a plurality of substantially parallel arms and a teeth formed between the plurality of substantially parallel arms, and wherein the multi-bar webbing lock prevents unnecessary movement of straps attached to the each of the plurality of main tongues, wherein each of the plurality of main tongues includes a first strap insertion region for connecting a strap to a first point and a second strap insertion region for connecting a strap to a second point.

9. A multi-point buckle assembly comprising:

a body including a top opening on a top surface and a plurality of side openings;

a release button disposed within the top opening; and a plurality of main tongues, wherein each of the plurality of main tongues includes a first strap insertion region for connecting a strap to a first point and a second strap insertion region for connecting a strap to a second point, wherein the plurality of strap insertion regions are perpendicular to each other.

10. A multi-point buckle assembly comprising:

a body including a top opening on a top surface and a plurality of side openings;

a release button disposed within the top opening; and a plurality of main tongues, wherein one of the plurality of main tongues includes a plurality of locking prongs formed on a plurality of substantially parallel arms, wherein each of the plurality of main tongues includes a first strap insertion region for connecting a strap to a first point and a second strap insertion region for connecting a strap to a second point.

11. The multi-point buckle assembly according to claim 10, wherein the plurality of locking prongs engage a plurality of retaining latches formed on the release button.

12. The multi-point buckle assembly according to claim 11, wherein one of the plurality of main tongues is inserted into the body without deflection of the plurality of substantially parallel arms, the plurality of locking prongs, or the plurality of retaining latches.

13. A multi-point buckle assembly comprising:

a body including a top opening on a top surface and a plurality of side openings, wherein the body provides a multi-bar webbing lock with a plurality of substantially parallel arms and a teeth formed between the plurality of substantially parallel arms, and wherein the multi-bar webbing lock prevents unnecessary movement of straps attached to the body;

a release button disposed within the top opening; and a plurality of main tongues, wherein each of the plurality of main tongues includes a first strap insertion region for connecting a strap to a first point and a second strap insertion region for connecting a strap to a second point.

14. A multi-point buckle assembly comprising:

a body including a top opening on a top surface, a plurality of side openings, and a plurality of channels;

a release button disposed within the top opening including a first surface; and a plurality of main tongues, one having a second surface to engage with the first surface of the release button, wherein one of the plurality of main tongues includes a plurality of locking prongs having the second surfaces and formed on a plurality of substantially parallel arms, wherein the plurality of side openings and the plurality of channels are formed in different planes and each of the plurality of main tongues is adapted to fit into each of the plurality of side openings.

15. The multi-point buckle assembly according to claim 14, wherein the plurality of locking prongs engage a plurality of retaining latches having the first surfaces and formed on the release button.

16. The multi-point buckle assembly according to claim 15, wherein one of the plurality of main tongues is inserted into the body without deflection of the plurality of substantially parallel arms, the plurality of locking prongs, or the plurality of retaining latches.

17. A multi-point buckle assembly comprising:

a body including a top opening on a top surface, a plurality of side openings, and a plurality of channels, wherein the body provides a multi-bar webbing lock with a plurality of substantially parallel arms and a teeth formed between the plurality of substantially parallel arms, and wherein the multi-bar webbing lock prevents unnecessary movement of straps attached to the body;

a release button disposed within the top opening including a first surface; and a plurality of main tongues, one having a second surface to engage with the first surface of the release button, wherein the plurality of side openings and the plurality of channels are formed in different planes and each of the plurality of main tongues is adapted to fit into each of the plurality of side openings.

18. A multi-point buckle assembly comprising:

a body including a top opening on a top surface, a plurality of side openings, and a plurality of channels;

a release button disposed within the top opening including a first surface; and a plurality of main tongues, one having a second surface to engage with the first surface of the release button, wherein one of the plurality of main tongues provides a multi-bar webbing lock with a plurality of substantially parallel arms and a teeth formed between the plurality of substantially parallel arms, and wherein the multi-bar webbing lock prevents unnecessary movement of straps attached to the each of the plurality of main tongues, wherein the plurality of side openings and the plurality of channels are formed in different planes and each of the plurality of main tongues is adapted to fit into each of the plurality of side openings.

* * * * *